US009770123B2

(12) United States Patent
Tan

(10) Patent No.: US 9,770,123 B2
(45) Date of Patent: Sep. 26, 2017

(54) HANGING BAG DISPENSER

(71) Applicant: Stephanie Tan, Harahan, LA (US)

(72) Inventor: Stephanie Tan, Harahan, LA (US)

( * ) Notice: Subject to any disclaimer, the term of this patent is extended or adjusted under 35 U.S.C. 154(b) by 36 days.

(21) Appl. No.: 14/835,602

(22) Filed: Aug. 25, 2015

(65) Prior Publication Data

US 2017/0055727 A1 Mar. 2, 2017

(51) Int. Cl.

| | |
|---|---|
| ***A47F 13/08*** | (2006.01) |
| ***A47F 9/04*** | (2006.01) |
| ***B65D 33/00*** | (2006.01) |
| ***B65B 67/12*** | (2006.01) |

(52) U.S. Cl.

CPC ..... *A47F 13/085* (2013.01); *A47F 9/042* (2013.01); *B65B 67/1266* (2013.01); *B65D 33/001* (2013.01)

(58) Field of Classification Search

CPC ..... B65D 33/001; A47F 13/085; A47F 9/042; B65B 67/1266

See application file for complete search history.

(56) References Cited

U.S. PATENT DOCUMENTS 361,852 A * 4/1887 Alderman ..... A47F 1/128 211/54.1
1,217,682 A * 2/1917 Baldwin ..... B65D 83/0805 221/46
1,412,382 A * 4/1922 Wright ..... A47F 13/085 211/54.1
1,642,619 A * 9/1927 Medlock ..... A47F 13/085 211/12
1,755,584 A * 4/1930 Weckert ..... A47F 13/085 211/53
1,772,079 A * 8/1930 Hanna ..... A47F 13/085 211/54.1
2,950,821 A * 8/1960 Hoofer ..... A47K 10/20 211/54.1
3,361,294 A * 1/1968 Bjerum ..... A47F 13/085 206/526
3,454,166 A * 7/1969 Dinges ..... A47F 1/04 206/526
4,407,473 A 10/1983 Howe
5,104,080 A * 4/1992 Berger ..... A47J 37/0786 108/152

(Continued)

*Primary Examiner* — Leslie A Nicholson, III
*Assistant Examiner* — Kimberley S Wright
(74) *Attorney, Agent, or Firm* — David A. Belasco; Belasco Jacobs & Townsley, LLP

(57) ABSTRACT

A hanging bag dispenser includes a bag support platform having a surface that contacts a last bag in a vertically supported bag pack. An angled mounting device is attached to the bag support platform to engage a mounting aperture that penetrates each bag in the bag pack. A positioning system is attached to the bag support platform and maintains the bag support platform at a sufficient height to allow the bag pack to extend downwardly from the mounting device. A pivotally mounted bag control arm is mounted to the bag support platform and permits installation of the bag pack on the mounting device when pivoted to a first, loading position and located to rest upon an outermost bag in the bag pack when pivoted to a second, control position. A surrounding control cage is attached to the dispenser to prevent a user from pulling a lower portion of the bag.

34 Claims, 23 Drawing Sheets

(56) References Cited

U.S. PATENT DOCUMENTS 5,335,788 A * 8/1994 Beasley ..... B65D 33/001 206/554
5,465,846 A * 11/1995 Blyth ..... B65D 33/001 206/554
5,584,402 A * 12/1996 Johnson ..... A47F 9/042 206/554
5,732,833 A * 3/1998 Alvarado ..... A47F 9/042 206/554
5,860,529 A 1/1999 Smithson
5,941,392 A * 8/1999 Huang ..... A47F 9/042 206/554
5,979,841 A * 11/1999 Piraneo ..... B65D 33/001 206/554
D433,857 S * 11/2000 Nguyen ..... D6/515
6,179,126 B1 1/2001 Smithson
6,257,422 B1 7/2001 Rios
6,446,811 B1 9/2002 Wilfong
6,502,371 B2 1/2003 DeMatteis
6,505,750 B1 * 1/2003 Nguyen ..... A47F 9/042 206/554
6,543,638 B2 * 4/2003 Wile ..... A47F 5/01 206/554
6,585,197 B1 * 7/2003 Daniels ..... A47F 9/042 206/554
6,619,479 B2 9/2003 Jones
6,729,483 B1 * 5/2004 Nguyen ..... A47F 9/042 206/554
6,772,909 B2 8/2004 Bateman
7,287,654 B2 * 10/2007 Nguyen ..... A47F 9/042 211/163
7,611,019 B2 * 11/2009 Alvarado ..... A47F 13/085 211/12
7,624,881 B2 * 12/2009 Wilfong, Jr. ..... A47F 13/085 211/59.1
7,850,018 B2 * 12/2010 Galle ..... A47F 13/085 211/85.15
7,926,669 B2 * 4/2011 Alvarado ..... A47F 13/085 211/85.15
8,210,354 B2 * 7/2012 Alvarado ..... A47F 13/085 206/554
8,381,921 B2 * 2/2013 Tan ..... A47F 9/042 211/12
8,397,923 B2 * 3/2013 Tan ..... A47F 9/042 211/12
8,496,134 B2 7/2013 Springer
8,567,618 B2 * 10/2013 Tan ..... A47F 9/042 211/85.15
8,960,493 B1 2/2015 Dennison
2004/0256279 A1 * 12/2004 Nguyen ..... A47F 9/042 206/554
2006/0102573 A1 * 5/2006 Alvarado ..... A47F 13/085 211/85.15
2007/0144989 A1 * 6/2007 Alvarado ..... A47F 13/085 211/85.15
2007/0176058 A1 * 8/2007 Kohn ..... A47F 9/042 248/100
2008/0053929 A1 * 3/2008 Nguyen ..... A47F 9/042 211/50
2008/0149785 A1 * 6/2008 Galle ..... A47F 13/085 248/97
2009/0289019 A1 * 11/2009 Alvarado ..... A47F 13/085 211/85.15
2010/0067831 A1 * 3/2010 Alvarado ..... B65D 33/001 383/37
2012/0118839 A1 * 5/2012 Tan ..... B65B 43/14 211/59.2
2012/0228246 A1 * 9/2012 Alvarado ..... B65D 33/001 211/59.2
2014/0166715 A1 * 6/2014 Tan ..... B65H 35/10 225/46
2014/0263121 A1 * 9/2014 Metcalfe ..... B65B 67/1266 211/85.15
2014/0311998 A1 * 10/2014 Tan ..... E05B 67/38 211/85.31
2015/0083677 A1 * 3/2015 Tan ..... A47F 13/085 211/59.1
2015/0108156 A1 * 4/2015 Tan ..... A47F 13/085 221/26

* cited by examiner

HANGING BAG DISPENSER

FIELD OF INVENTION

This invention relates to the field of dispensing systems for plastic and other film bags and more specifically to dispensers for vertically hung bags and bag packs with hanging apertures.

BACKGROUND OF THE INVENTION

As mounting space is usually at a premium in supermarkets and grocery stores, it is desirable to have bag dispensing systems that use a minimum of such space, are adaptable to a variety of dispenser mounting systems and provide means for keeping bags neat and orderly in the store. It is also desirable that the supply of bags remaining in the dispenser be readily visible to service personnel so that bag supplies can be timely maintained. In order to dispense bags economically and environmentally, it is desirable that only a single bag is dispensed at one time and that the bag remains in the hand of the user as it is dispensed.

Thin film produce bags have often been dispensed from roll mounted bag systems. These systems are typically used for fresh produce, and can help with limited space problems when they are designed to use folded bags. These relatively large bags are folded two to four times along vertical or horizontal axes and then formed into compact rolls. The bags are typically joined to one another using perforations. Some bags, known as star-sealed bags are folded twice and then sealed across their bottom edges. This produces a bag with an extremely strong bottom.

However, when using roll mounted bags, it is critical that the bags are correctly loaded into the bag dispenser and that the bag roll cannot accidently leave the dispenser when a user attempts to pull a bag from the roll. Should this happen, the bag roll could end up on the floor of store, providing a potentially hazardous condition. It is even possible for a bag roll to fly out of the dispenser and strike a grocery patron when he attempts to pull a bag from the roll. In order to obviate these problems, the present invention dispenses bags from a vertically oriented hanging bag stack. These compact dispensers occupy a relatively small footprint in a retail store, eliminate the danger of loose bag rolls, and also eliminate the need to open a folded bag. These dispensers provide a compact system that is easy and safe to use as well as being easy to maintain and economical to use. Some examples of dispensers for hanging bags and related inventions include the following.

U.S. Pat. No. 6,729,483, issued to Nguyen et al., discloses a thermoplastic bag dispensing system for use in dispensing thermoplastic bags from a stack. The dispenser comprises a vertical support rod supporting planar surface in top rack which serves as a horizontal support surface. Support members in the form of spikes extend from the horizontal surface to receive a bag pack through openings provided at the upper edge of that bag pack. The bag pack thus hangs via the support members from the horizontal support surface and over a declined (inclined) support surface. A pivotally mounted bag pack support member is also mounted on the horizontal support surface and maybe raised in order to mount the bag pack then lower it into position over the bags. Since the bags within bag pack are of the self-opening type, as the top bag is removed from a dispenser the immediately following bag is pulled into an open position and prepared for subsequent dispensing.

U.S. Pat. No. 8,960,493, issued to Dennison et al., is directed to a method and apparatus for disposable glove dispensing. The glove is dispensed one at a time while providing for a second member to be opened when the first member is removed.

U.S. Pat. No. 8,496,134, issued to Springer et al., illustrates a pet waste bag dispenser. The reference discloses an example of a plastic bag dispenser system that utilizes a positioner, or stabilizer, in order to keep individual bags of a pack conveniently stacked for removal of one bag at a time.

U.S. Patent Application No. 2015/00883677, published for Tan, is directed to a bag dispenser rack that incorporates mounting spikes and pivotally mounted support surface to keep the bags in order, while providing for dispensing of individual bags from a pack with the following bag brought conveniently into open configuration for use thereafter.

U.S. Pat. No. 6,502,371, issued to DeMatteis, illustrates the process of die-cutting bag stacks to form individual bag tops, die-cut handle apertures, or other mounting apertures, die blade configurations forming the vent lines of an array of vent apertures are also used to bond the outer surfaces of the front and rear bag walls together. The die-cutting operation selectively bonds the successive front and rear bag walls together at or adjacent the cut edges of the vent lines, thereby allowing the bags in a bag stack to subsequently self-open when dispensed.

U.S. Pat. No. 6,446,811, issued to Wilfong, Jr., discloses a pack of self-opening serially-arranged plastic bags of the "star-seal" type defining eight superimposed wall layers in the bag. Mounting tabs form a part of top portions of each of the eight layers and are positioned in superimposed positions and each includes an aperture for mounting the tabs on a tab retaining device of a rack in a non-front-side-free manner. Each of the tabs includes a mechanism for rendering the tab detachable and providing a predetermined detaching strength. In one embodiment, each of the tabs are detachable from the rack and in another embodiment, each of the tabs are detachable from the bag. A frangible bond is formed between the rear layer and the front layer of each successive bag in the pack. This frangible bond has a predetermined strength (1) which is greater than the predetermined detaching strength of two of the tabs and (2) is weaker than the predetermined detaching strength of the remaining six tabs to allow the leading bag of the pack (when pulled by a user for removal) to disengage from the pack, while (before disengagement) pulling the succeeding bag in the pack to cause detaching of the two leading of the tabs for self-opening of the succeeding bag.

It is an objective of the present invention to provide a bag dispensing system that provides large size film bags that are dispensed from a system that occupies a minimum of floor space in a retail store. It is a further objective to provide a system that does not require roll mounted bags. It is a still further objective of the invention to provide a dispensing system adaptable to a variety of different mountings. It is yet a further objective to provide such a system that provides a visual indication of the need to refill the dispenser. It is still a further objective to provide a dispenser that can accommodate multiple bag sizes. Finally, it is an objective of the present invention to provide a bag dispensing system that is durable, inexpensive, easy to keep clean and simple to use.

While some of the objectives of the present invention are disclosed in the prior art, none of the inventions found include all of the requirements identified.

SUMMARY OF THE INVENTION

The present invention addresses all of the deficiencies of prior art hanging bag dispensers and satisfies all of the objectives described above.

(1) A hanging bag dispenser providing the desired features may be constructed from the following components. A bag support platform is provided. The platform provides a surface. The surface contacts a last bag in a vertically supported bag pack. The bag pack has a first predetermined width and a first predetermined length. At least one mounting device is provided. The device is attached to the bag support platform and is sized, shaped and located to engage a mounting aperture. The aperture penetrates each bag in the bag pack. A positioning system is provided. The system is attached to the bag support platform and maintains the bag support platform at a height sufficient to allow the bag pack to extend downwardly for at least the first predetermined length. At least one pivotally mounted bag control arm is provided. The bag control arm is mounted to the bag support platform and is sized shaped and located to permit installation of the bag pack on the at least one mounting device when pivoted to a loading position and located to constrain an outermost bag in the bag pack when pivoted to a control position.

(2) In a variant of the invention, at least one mounting device is upwardly angled.

(3) In another variant, the at least one mounting device includes a bendable tab.

(4) In still another variant, the at least one mounting device includes an angled hook.

(5) In yet another variant, the at least one pivotally mounted bag control arm rests upon the outermost bag in the bag pack when pivoted to the control position.

(6) In a further variant, the positioning system is selected from the group comprising floor stands, wall mounts, surface mounts, shelf mounts, glue, screws, nails and looping and hooking fasteners (Velcro®).

(7) In still a further variant, first and second horizontal control arms are provided. The control arms are attached either to or adjacent to the bag support platform and are sized, shaped and located to align with hanging apertures located in handles of a T-shirt style bag.

(8) In a variant of the invention, a surrounding control device is provided. The device is attached to either the bag support platform or the positioning system. The cage is sized shaped and located to surround at least a lower portion of the bag pack, thereby preventing a user from pulling a bag from a lower portion of the bag.

(9) In another variant, the control device is of wire form construction.

(10) In yet another variant, the control device is formed of wood, plastic or metal.

(11) In still another variant, the support platform is either of a vertical and angled planar surface.

(12) In a further variant, the support platform is horizontally oriented and has either a cylindrical or convex curved surface.

(13) In still a further variant, the at least one mounting device is a mounting spike.

(14) In yet a further variant, the mounting spike has an angled portion adjacent a distal end of the spike.

(15) In another variant of the invention, the at least one mounting device is slidably mounted to the bag support platform and adapted to accommodate bags having a variety of differently located mounting apertures.

(16) In still another variant, the at least one mounting device is a mounting hook.

(17) In yet another variant, the mounting hook is slidably mounted to the bag support platform and adapted to accommodate bags having a variety of differently located mounting apertures.

(18) In a further variant, the positioning system is any of a floor stand, a counter mount and a surface stand. The positioning system is adapted to support at least two of the bag support platform.

(19) In still a further variant, the positioning system is a wall mount. The wall mount supports the bag support platform.

(20) In yet a further variant, the positioning system is a counter mount. The counter mount supports the bag support platform.

(21) In another variant of the invention, the at least one pivotally mounted bag control arm contacts the outermost bag of the bag pack at a single point.

(22) In still another variant, the at least one pivotally mounted bag control arm includes a pair of control arms. The control arms contact the outermost bag of the bag pack at two points.

(23) In a further variant, the at least one pivotally mounted bag control arm includes at least one weight. The weight provides increased friction between the control arm and the outermost bag.

(24) In still a further variant of the invention, the at least one pivotally mounted bag control arm includes first and second bag control elements. The first and second elements are attached to a pivot rod. The pivot rod is slidably located within a bearing structure. The bearing structure is attached to the bag support platform.

(25) In yet a further variant, the bag further includes a central handle, the central handle selected from the group that includes round, oval, kidney-shaped and racetrack (elongated round).

(26) In another variant of the invention, the bag further includes a top seam, a bottom seam, a U-shaped cut-out commencing at the top seam, extending downwardly toward the bottom seam, proceeding across the bag and rejoining the top seam, a central hanging aperture, the top seam and bag material adjacent the U-shaped cut-out forming first and second bag handles, the bag handles has first and second hanging apertures located in an upper portion of the handles.

(27) In still another variant, the bag further includes at least one side gusset.

(28) In yet another variant, the bag pack further includes self-opening bags. The self-opening bags employ technology selected form the group comprising: corona treatment, corona treatment with pressure, knife cutting, adhesives, hot staking, cold pinning, special material formulations and adhering inks.

(29) In a further variant, the special material formulation includes 40-48 wt. % high density, high molecular weight polyethylene, 12-20 wt. % high density, medium molecular weight polyethylene, 20-30 wt. % linear low density polyethylene, 0-8 wt. % color concentrate.

(30) In still a further variant, the special material formulation further includes 0.5 wt. % slip and antiblock compound.

(31) In yet a further variant, the special material formulation further includes 1-3 wt. % calcium carbonate.

(32) In another variant of the invention, the special material formulation further includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(33) In still another variant, 10-15 wt. % of the linear low density polyethylene has a density ranging from 0.923-0.924 gm/cc.

(34) In yet another variant, 10-15 wt. % of the linear low density polyethylene has a melt index ranging from 0.25-0.30 gm/10 minutes.

(35) In a further variant, the high density, medium molecular weight polyethylene has a density ranging from 0.937-0.947 gm/cc.

(36) In still a further variant, the high density, medium molecular weight polyethylene has a melt index ranging from 0.10-0.30 gm/10 minutes.

(37) In yet a further variant, a central mounting hook and first and second horizontal control arms are provided. The mounting hook and the control arms are attached either to or adjacent to one of the at least two of the bag support platforms. The mounting hook and the first and second horizontal control arms are sized, shaped and located to align with hanging apertures located in bag material adjacent a U-shaped cut-out and handles of a T-shirt style bag, respectively.

(38) In another variant of the invention, the positioning system supports two bag support platforms. The platforms are located at right angles to each other.

(39) In a final variant of the invention, the dispenser includes at least one removable surrounding control device. The device is attached to either the bag support platform or the positioning system. The device is sized shaped and located to surround at least a lower portion of the bag pack, thereby preventing a user from pulling a bag from a lower portion of the bag.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) A hanging bag dispenser 10 providing the desired features may be constructed from the following components. As illustrated in FIGS. 1-10, bag support platform 14 is provided. The platform 14 provides a surface 18. The surface 18 contacts a last bag 22 in a vertically supported bag pack 26. The bag pack 26 has a first predetermined width 30 and a first predetermined length 34. At least one mounting device 38 is provided. The device 38 is attached to the bag support platform 14 and is sized, shaped and located to engage a mounting aperture 42. The aperture 42 penetrates each bag 46 in the bag pack 26. A positioning system 50 is provided. The system 50 is attached to the bag support platform 14 and maintains the bag support platform 14 at a height 54 sufficient to allow the bag pack 26 to extend downwardly for at least the first predetermined length 34. At least one pivotally mounted rigid bag control arm 58 is provided. As illustrated in FIGS. 3A and 4A, the rigid bag control arm 58 is mounted to the bag support platform 14 and is sized shaped and located to permit installation of the bag pack 26 on the at least one mounting device 38 when pivoted to a loading position 62 and located to constrain an outermost bag 66 in the bag pack 26 when pivoted to a control position 70. The at least one pivotally mounted rigid bag control arm 58 configured to contact the outermost bag 66 in the vertically supported bag pack 26 at only a surface adjacent to a distal end of the at least one pivotally mounted rigid bag control arm 58 when the rigid bag control arm 58 is pivoted to the control position 70.

(2) In a variant of the invention, at least one mounting device 38 is upwardly angled.

Figure 3:
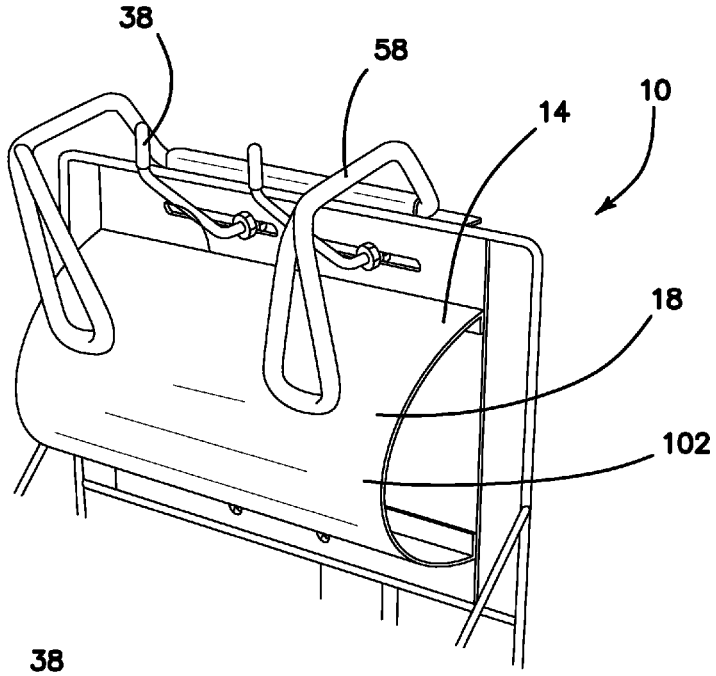
FIG. 3 is a partial perspective view of the FIG. 1 embodiment illustrating a cylindrical bag support platform with slidably attached mounting spikes.
Figure 3A:
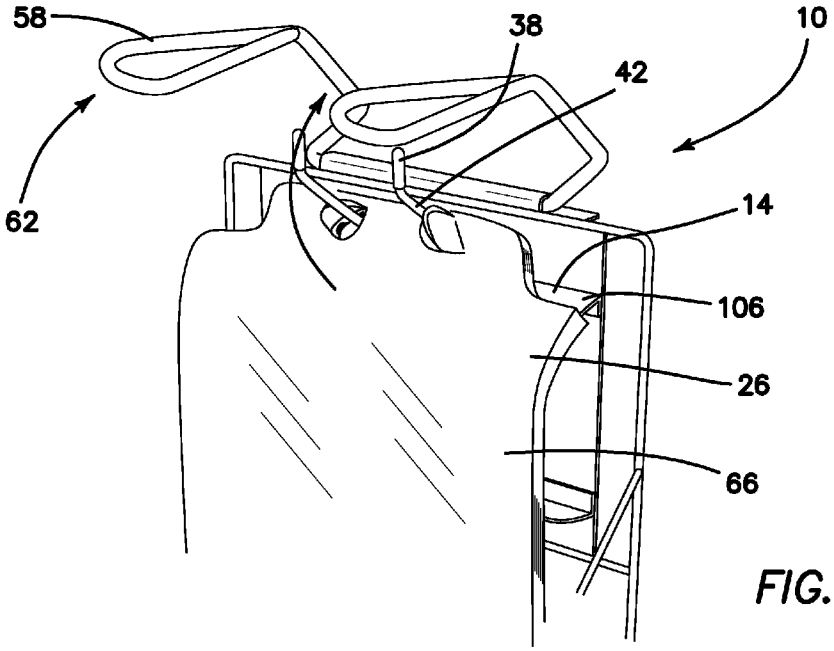
FIG. 3A is a partial perspective view of the FIG. 1 embodiment illustrating a convex bag support platform and the bag control arm in the loading position.
Figure 3B:
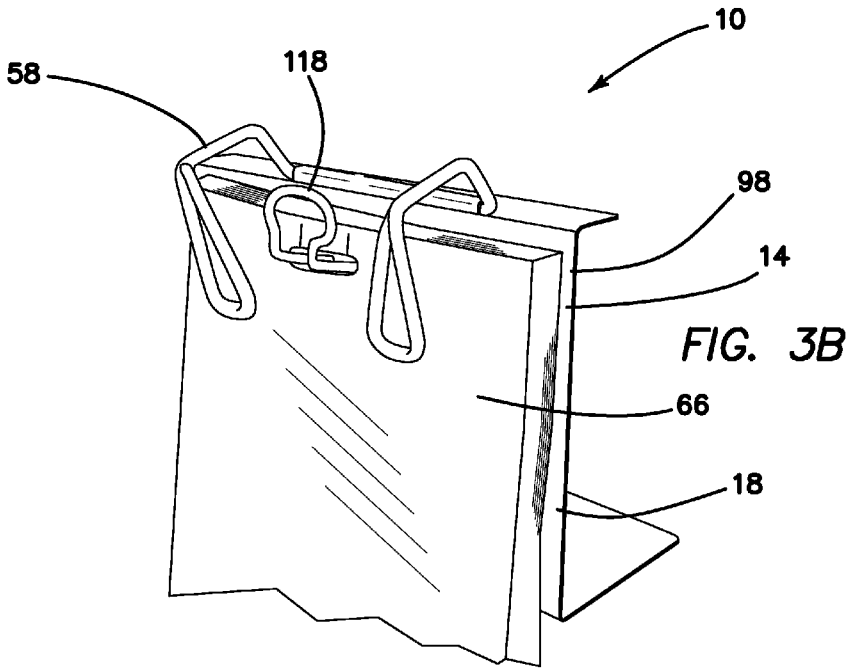
FIG. 3B is a partial perspective view of the FIG. 1 embodiment illustrating a mounting hook attached to an angled bag support platform.
Figure 3C:
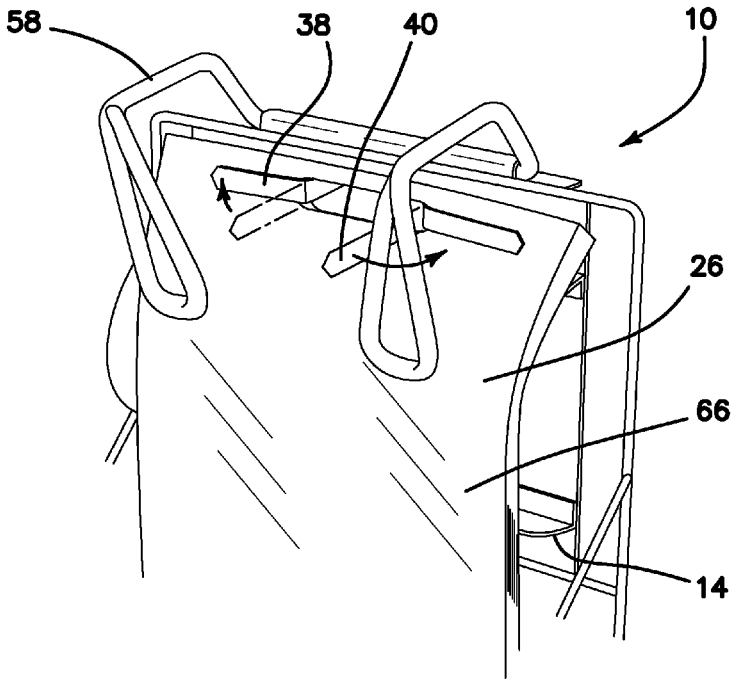
FIG. 3C is a partial perspective view of the FIG. 1 embodiment illustrating a bendable tab mounting device.

(3) In another variant, as illustrated in FIG. 3C, the at least one mounting device 38 includes a bendable tab 40.

Figure 4:
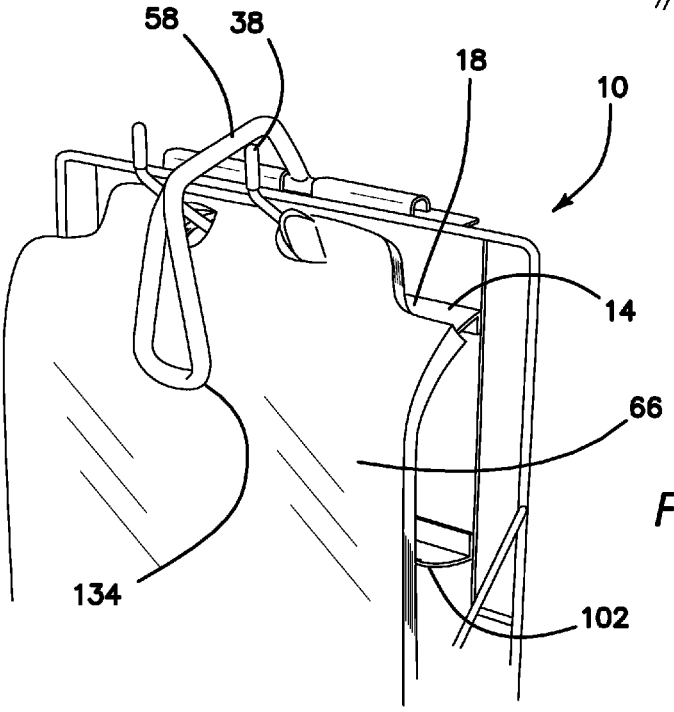
FIG. 4 is a partial perspective view of the FIG. 1 embodiment illustrating a dispenser with a single bag control arm.
Figure 4A:
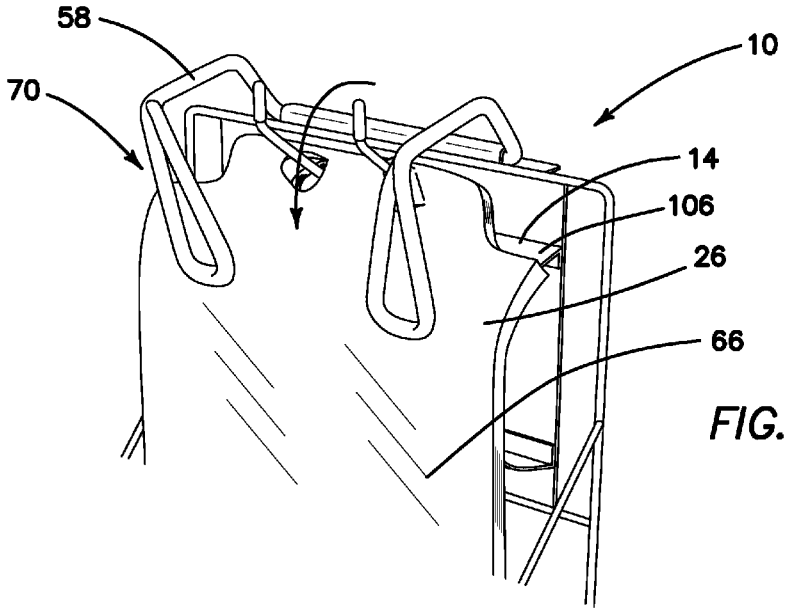
FIG. 4A is a partial perspective view of the FIG. 1 embodiment illustrating a convex bag support platform and the bag control arm in the control position.
Figure 4B:
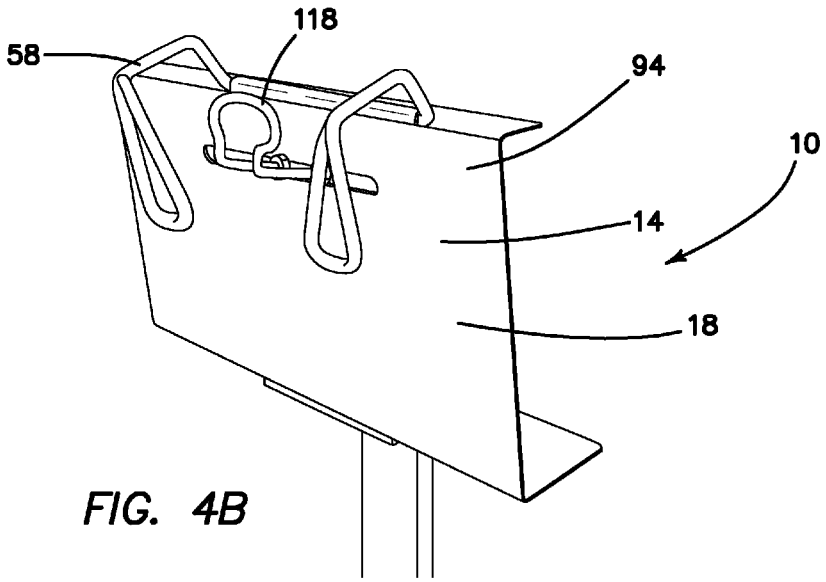
FIG. 4B is a partial perspective view of the FIG. 1 embodiment illustrating a slidably attached mounting hook attached to a vertical bag support platform.
Figure 4C:
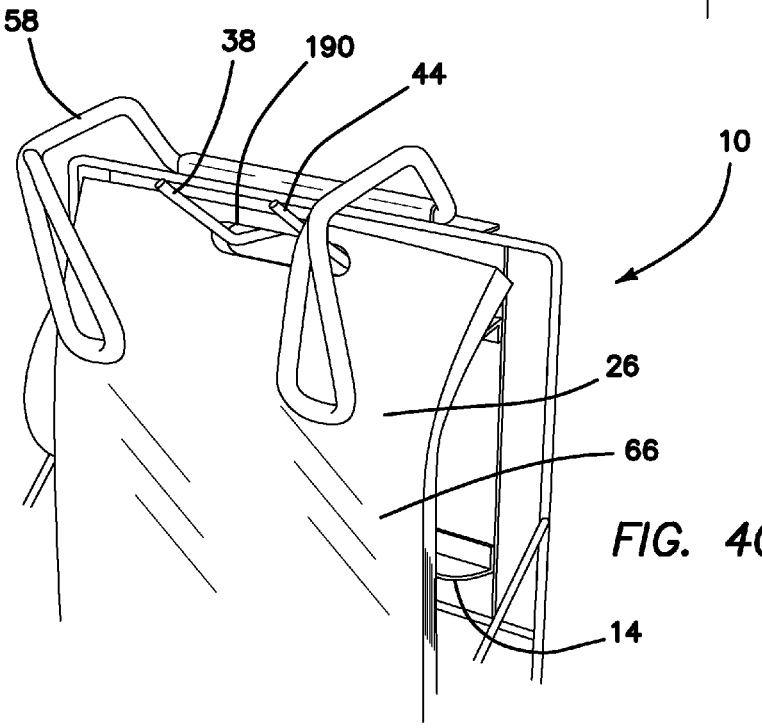
FIG. 4C is a partial perspective view of the FIG. 1 embodiment illustrating an angled hook mounting device and a race track handled bag.

(4) In still another variant, as illustrated in FIG. 4C, the at least one mounting device 38 includes an angled hook 44.

Figure 3D:
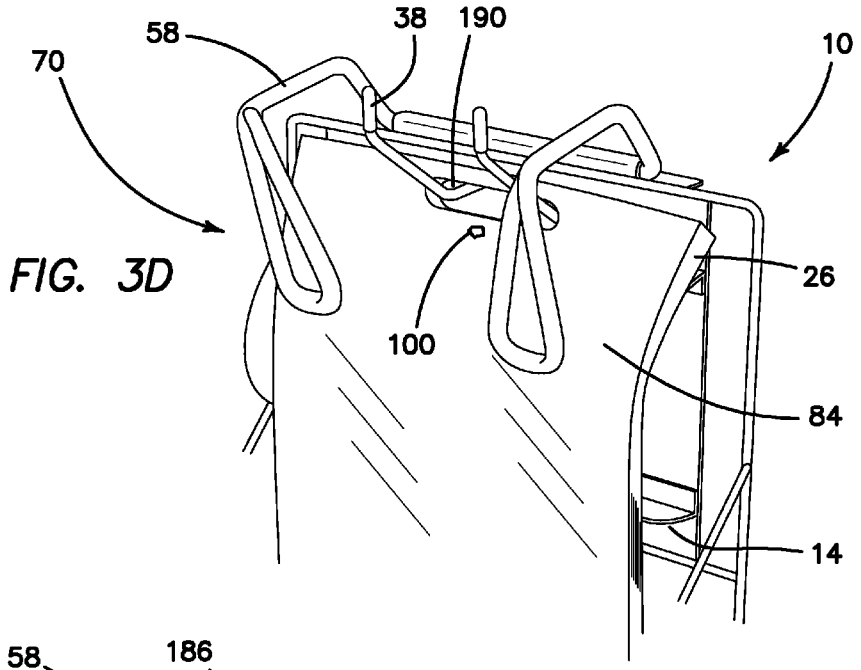
FIG. 3D is a partial perspective view of the FIG. 1 embodiment illustrating the control arm resting on the outermost bag of the bag pack of race track handled bags and a glue spot adhesion means.
Figure 4D:
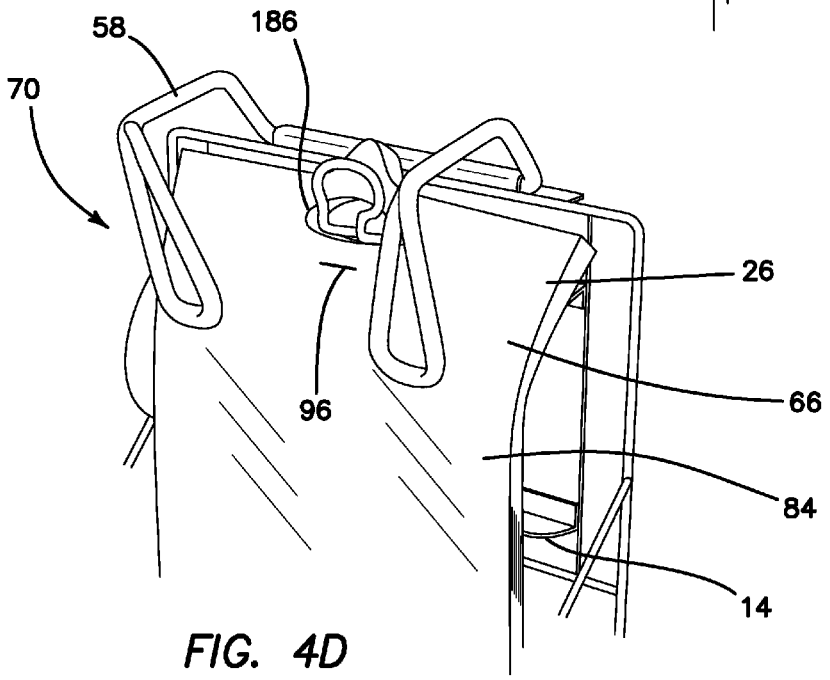
FIG. 4D is a partial perspective view of the FIG. 1 embodiment illustrating the control arm resting on the outermost bag of the bag pack of bags with kidney-shaped handle opening and a knife cut adhesion means.

(5) In yet another variant, as illustrated in FIGS. 3D and 4D, the at least one pivotally mounted bag control arm 58 rests upon the outermost bag 66 in the bag pack 26 when pivoted to the control position 70.

(6) In a further variant, as illustrated in FIGS. 1, 1A, 7, 7A and 10, the positioning system 50 is selected from the group comprising floor stands 122, wall mounts 126, surface mounts (not shown), counter mounts 130, glue (not shown), screws 52, nails and looping and hooking fasteners (Velcro®) 56.

(7) In still a further variant, first 60 and second 64 horizontal control arms are provided. The control arms 60, 64 are attached either to or adjacent to the bag support platform 14 and are sized, shaped and located to align with hanging apertures 68, 72 located in handles 76, 78 of a T-shirt style bag 80.

(8) In a variant of the invention, as illustrated in FIGS. 1, 2, 7 and 10, a surrounding control device 74 is provided. The device 74 is attached to either the bag support platform 14 or the positioning system 50. The cage 74 is sized shaped and located to surround at least a lower portion 78 of the bag pack 26, thereby preventing a user 82 from pulling a bag 46 from a lower portion 86 of the bag 46, as illustrated in FIG. 8.

(9) In another variant, the control device 74 is of wire form construction 90.

Figure 1:
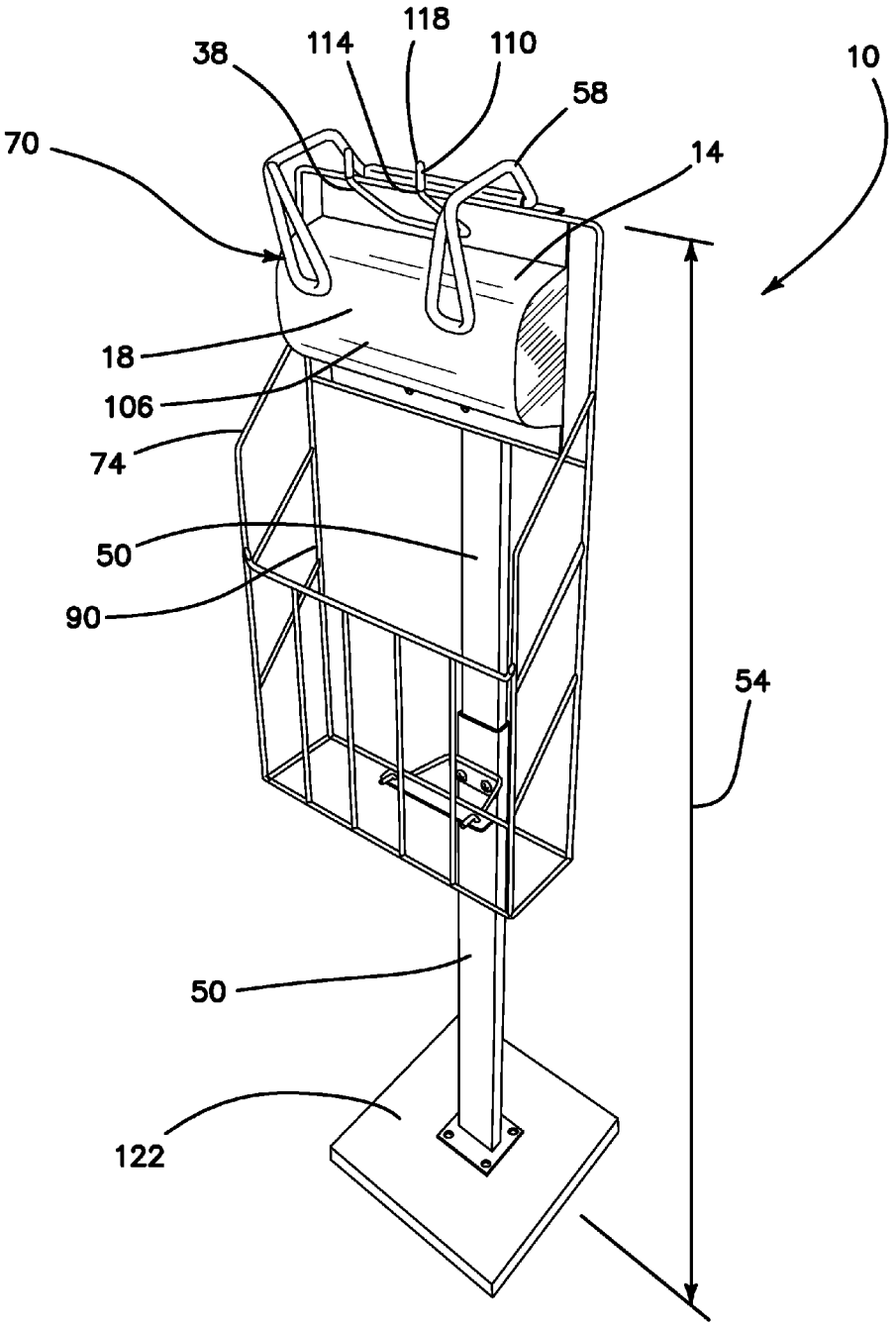
FIG. 1 is a perspective view of the preferred embodiment of the invention illustrating the dispenser attached to a floor mounting.
Figure 1A:
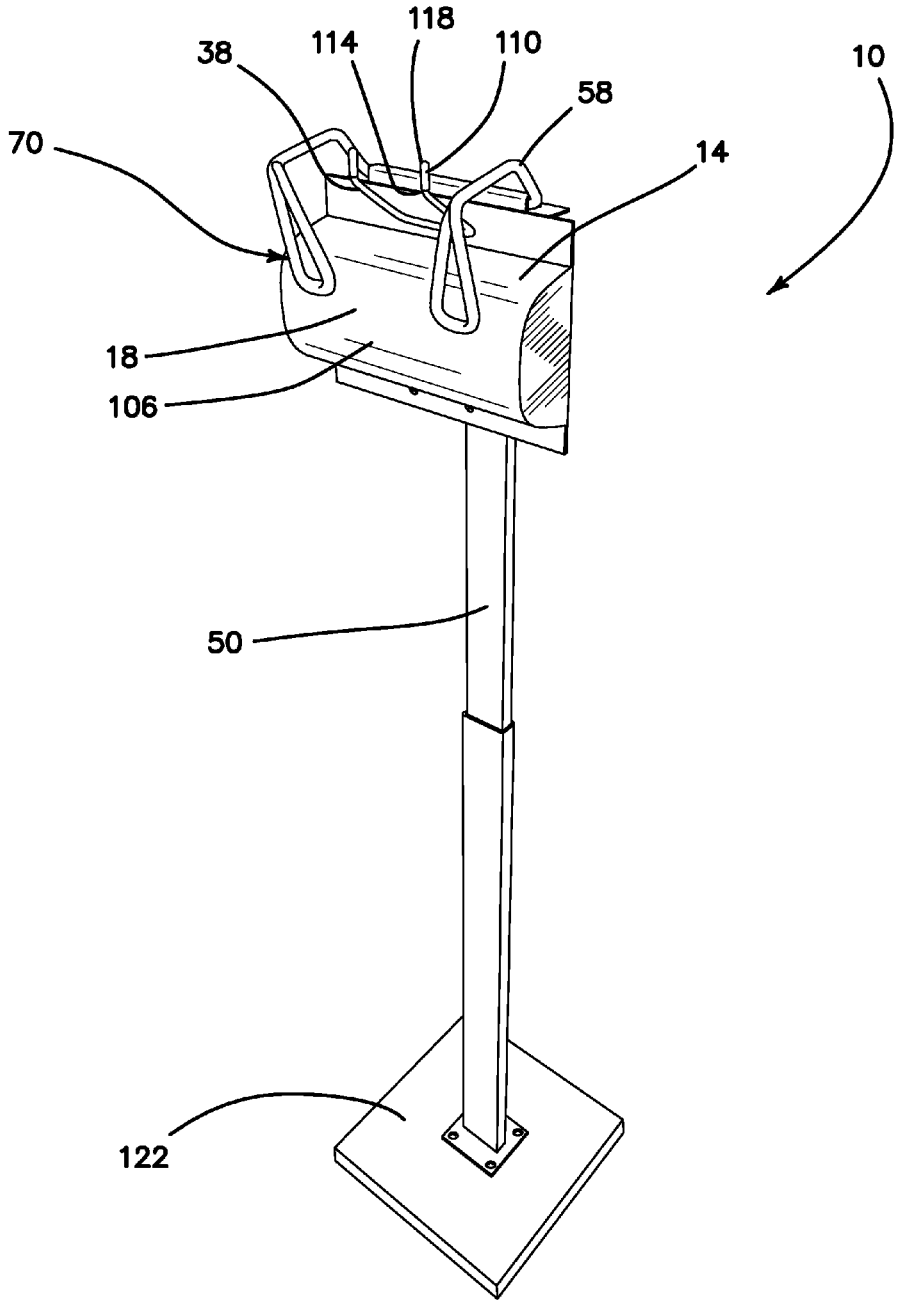
FIG. 1A is a perspective view of the FIG. 1 embodiment without the surrounding control device.
Figure 1B:
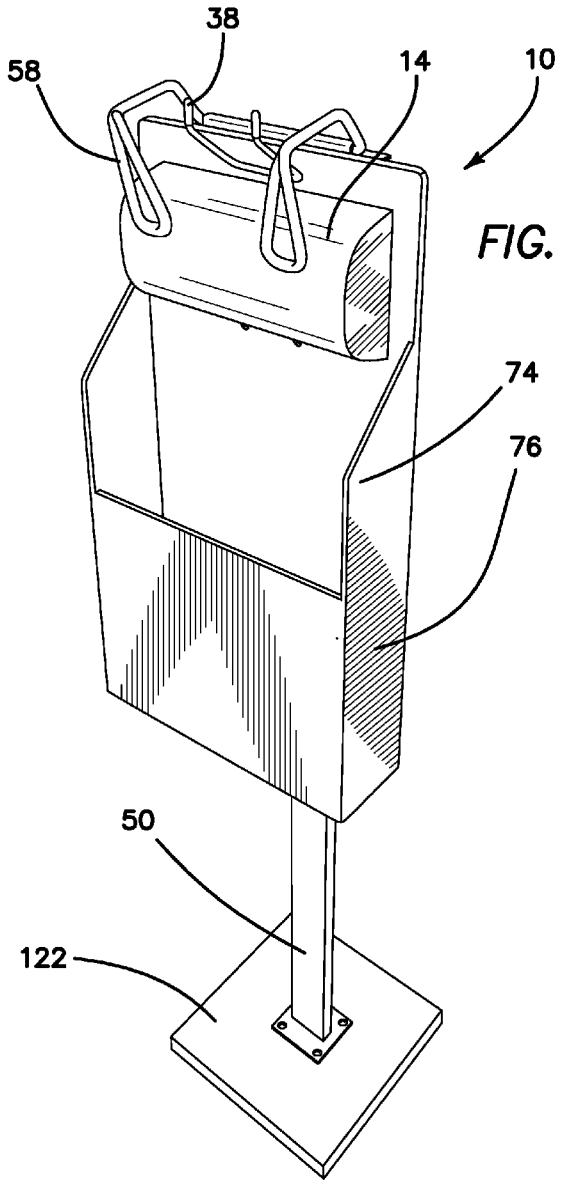
FIG. 1B is a perspective view of the FIG. 1 embodiment with a plastic surrounding control device.
Figure 7A:
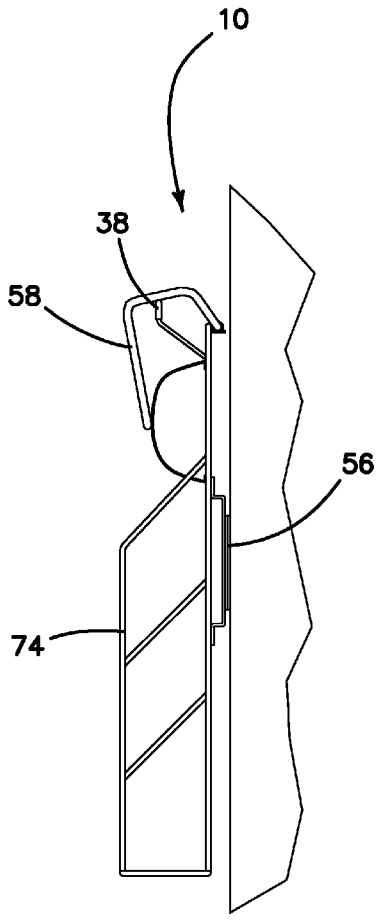
FIG. 7A is perspective view of the FIG. 1 embodiment illustrating a wall mounting positioning system with a looping and hooking attachment.
Figure 1C:
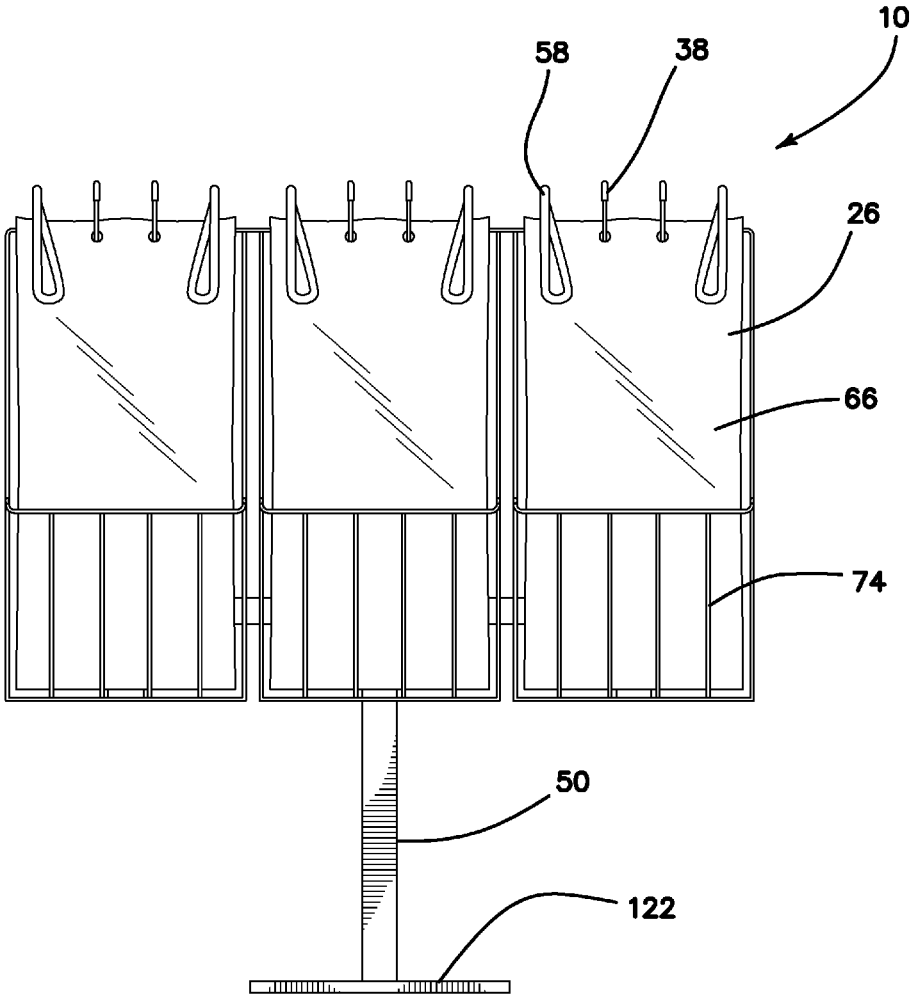
FIG. 1C is a perspective view of the FIG. 1 embodiment illustrating the positioning system supporting three bag support platforms.

(10) In yet another variant, as illustrated in FIG. 1B, the control device 74 is formed of wood (not shown), plastic 76 or metal (not shown).

(11) In still another variant, as illustrated in FIGS. 3B and 4B, the support platform 14 is either of a vertical 94 and angled 98 planar surface.

(12) In a further variant, as illustrated in FIGS. 1, 3, 3A, 4 and 4A, the support platform 14 is horizontally oriented and has either a cylindrical 102 or convex 106 curved surface, the surface 102, 106 extending outwardly from the positioning system 50 and being either cylindrical 102 or convex 106 for its entire width where it contacts the vertically supported bag pack 26.

(13) In still a further variant, the at least one mounting device 38 is a mounting spike 110.

(14) In yet a further variant, the mounting spike 110 has an angled portion 114 adjacent a distal end 118 of the spike 110.

(15) In another variant of the invention, as illustrated in FIG. 3, the at least one mounting device 38 is slidably mounted to the bag support platform 14 and adapted to accommodate bags 46 having a variety of differently located mounting apertures 42.

(16) In still another variant, as illustrated in FIG. 3B, the at least one mounting device 38 is a mounting hook 118.

(17) In yet another variant, as illustrated in FIG. 4B, the mounting hook 118 is slidably mounted to the bag support platform 14 and adapted to accommodate bags 46 having a variety of differently located mounting apertures 42.

(18) In a further variant, as illustrated in FIGS. 1, 1A, 1B, 1C, 1D, 1E and 2, the positioning system 50 is any of a floor stand 122, a counter mount 130 and a surface mount (not shown). The positioning system 50 is adapted to support at least two of the bag support platform 14.

Figure 7:
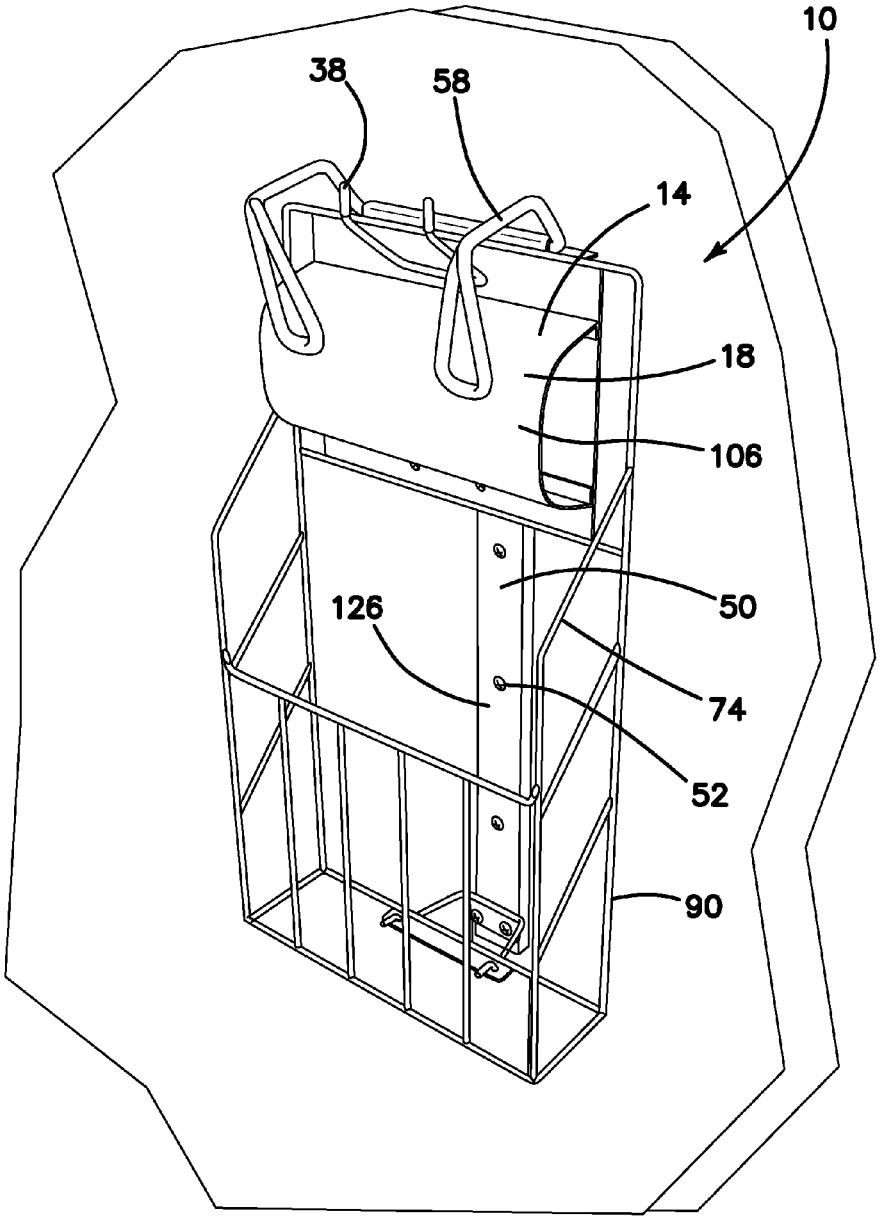
FIG. 7 is perspective view of the FIG. 1 embodiment illustrating a wall mounting positioning system.
Figure 8:
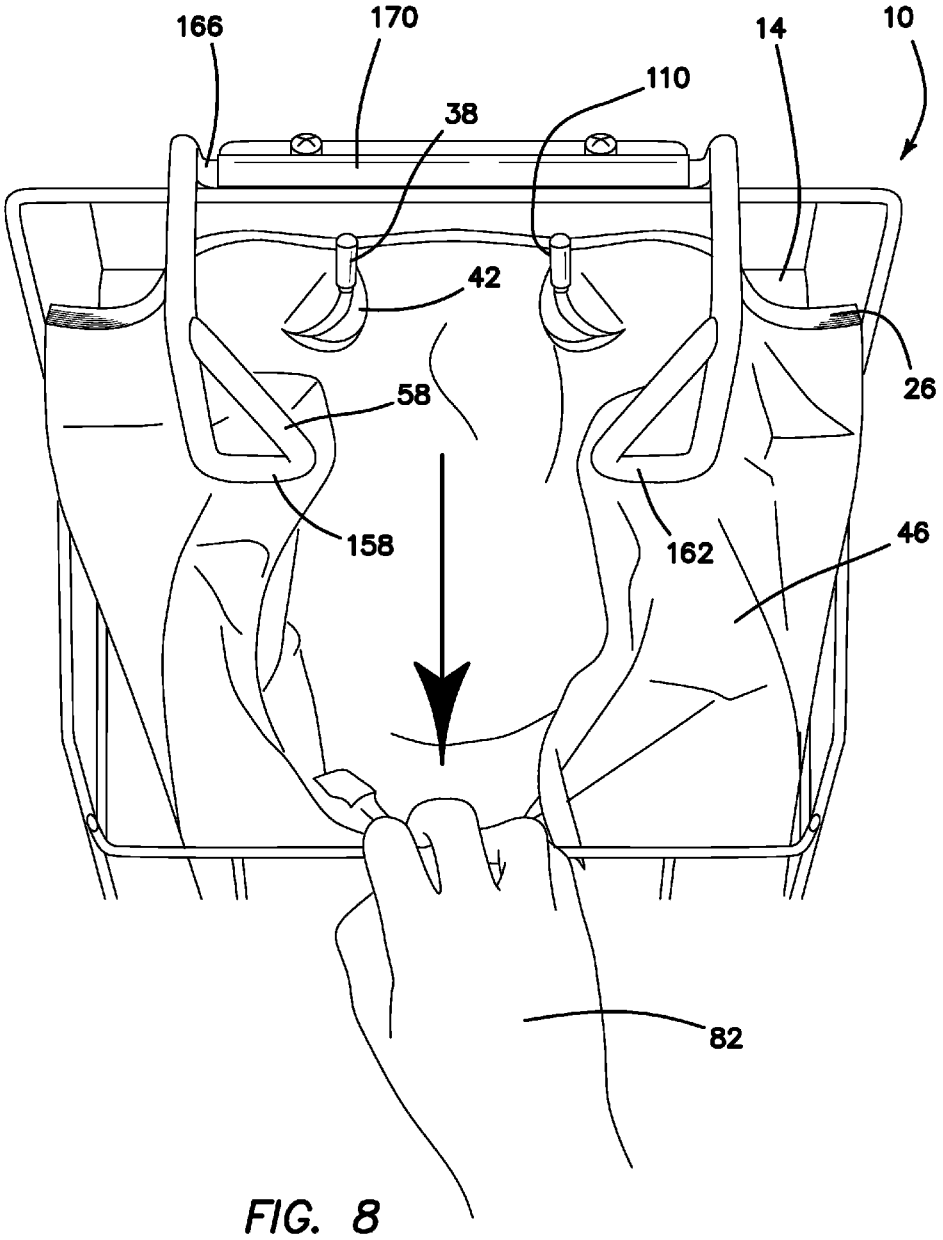
FIG. 8 is a partial perspective view of the FIG. 1 embodiment illustrating a user removing a bag from the dispenser.

(19) In still a further variant, as illustrated in FIG. 7, the positioning system 50 is a wall mount 126. The wall mount 126 being located adjacent a lower portion of the bag support platform 14 and supporting the bag support platform 14.

Figure 10:
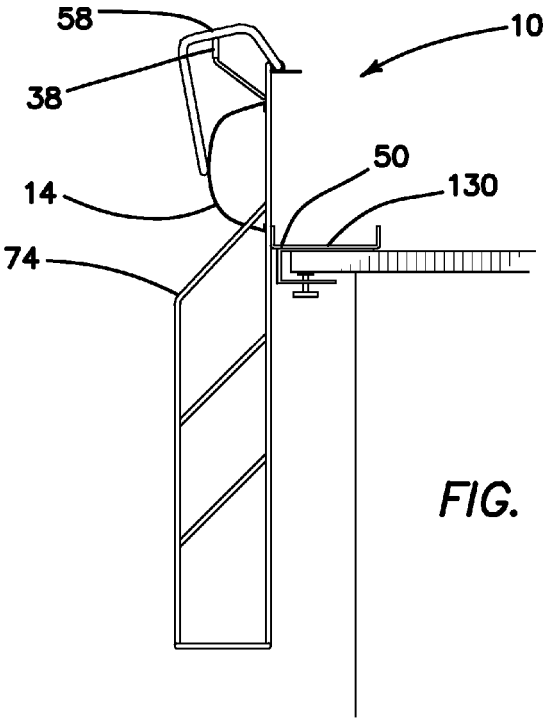
FIG. 10 is a side elevational view of the FIG. 1 embodiment illustrating a counter mounted positioning system.

(20) In yet a further variant, as illustrated in FIG. 10, the positioning system 50 is a counter mount 130. The counter mount 130 being located adjacent a lower portion of the bag support platform 14 and supporting the bag support platform 14.

(21) In another variant of the invention, as illustrated in FIG. 4, the at least one pivotally mounted bag control arm 58 contacts the outermost bag 66 of the bag pack 26 at a single point 134.

Figure 5:
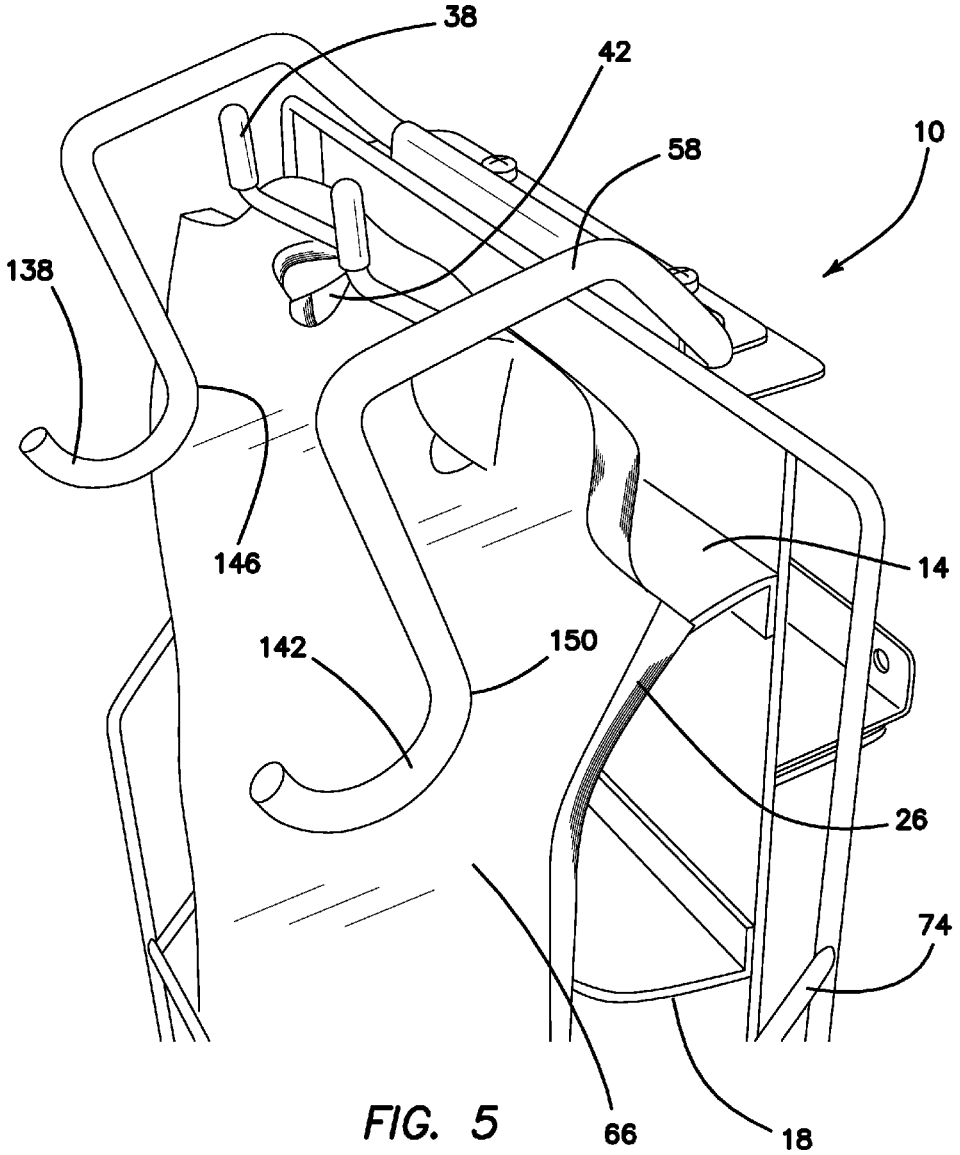
FIG. 5 is a partial perspective view of the FIG. 1 embodiment illustrating pivotally mounted bag control elements contacting the bag pack at two points.

(22) In still another variant, as illustrated in FIG. 5, the at least one pivotally mounted bag control arm 58 includes a pair of control arms 138, 142. The control arms 138, 142 contact the outermost bag 66 of the bag pack 26 at two points 146, 150.

Figure 6:
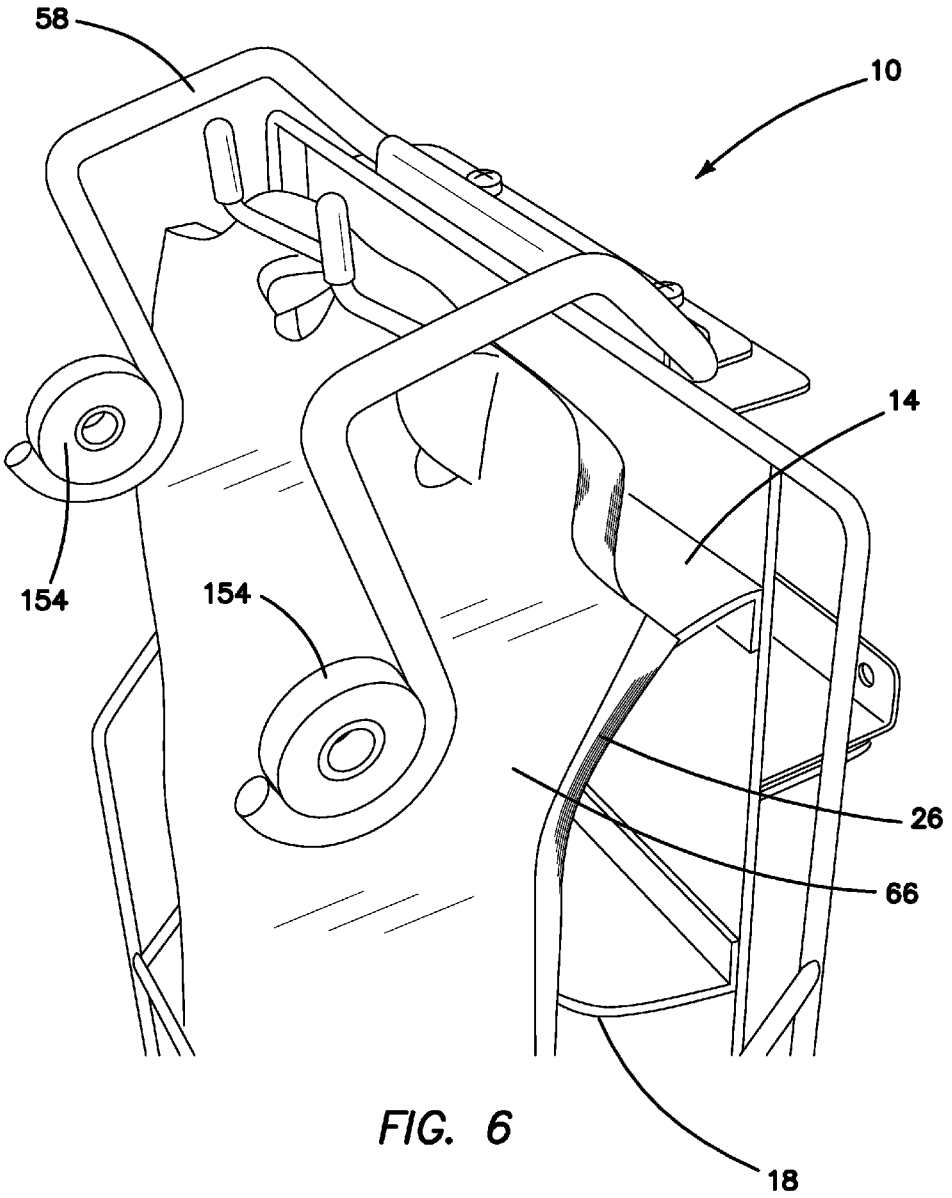
FIG. 6 is a partial perspective view of the FIG. 1 embodiment illustrating weights attached to the bag control elements.

(23) In a further variant, as illustrated in FIG. 6, the at least one pivotally mounted bag control arm 58 includes at least one weight 154. The weight 154 provides increased friction between the control arm 58 and the outermost bag 66.

Figure 9:
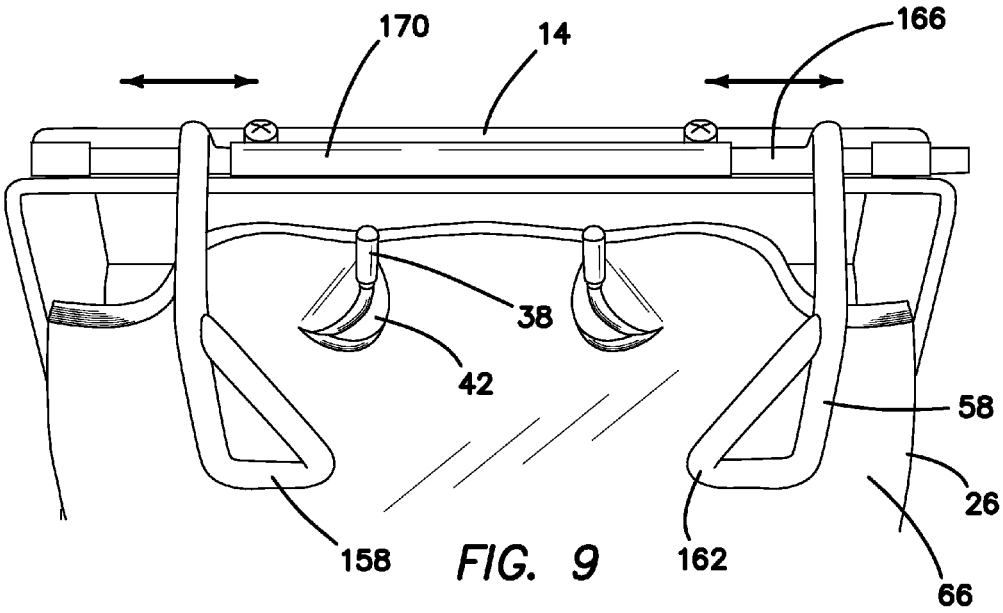
FIG. 9 is a partial perspective view of the FIG. 1 embodiment illustrating the pivotal mounting of the bag control elements.

(24) In still a further variant, as illustrated in FIGS. 8 and 9, the at least one pivotally mounted bag control arm 58 includes first 158 and second 162 bag control elements. The first 158 and second 162 elements are attached to a pivot rod 166. The pivot rod 166 is slidably located within a bearing structure 170. The bearing structure 170 is attached to the bag support platform 14.

(25) In yet a further variant, as illustrated in FIGS. 3D, 3F, 4D and 4E, the bag further includes a central handle 174. The central handle 174 is selected from the group that includes round 178, oval 182, kidney-shaped 186 and racetrack (elongated round) 190.

Figure 3E:
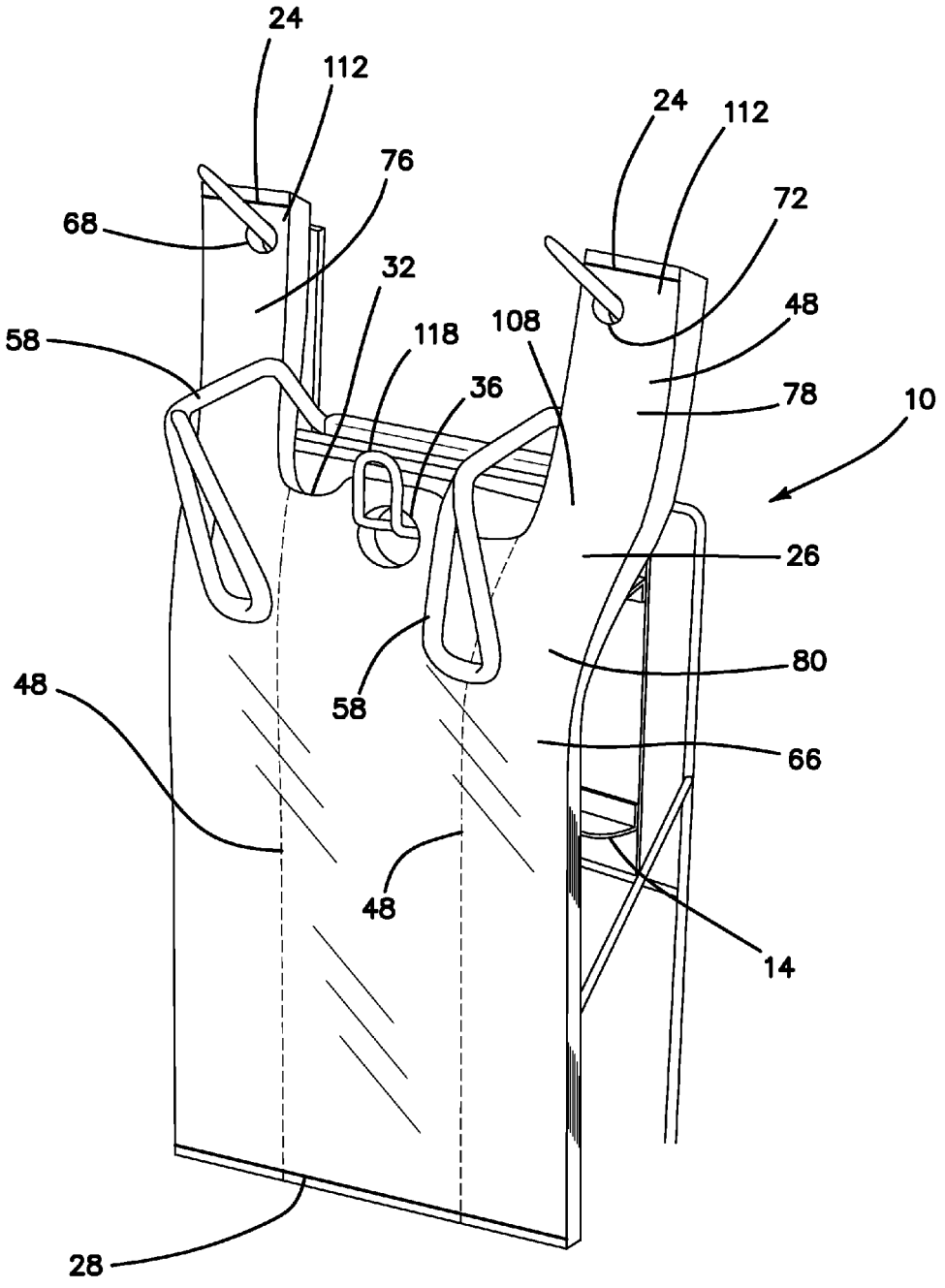
FIG. 3E is a partial perspective view of the FIG. 1 embodiment illustrating a dispenser adapted for T-shirt-style bags having a central round bag support aperture fitted over a mounting hook.
Figure 3F:
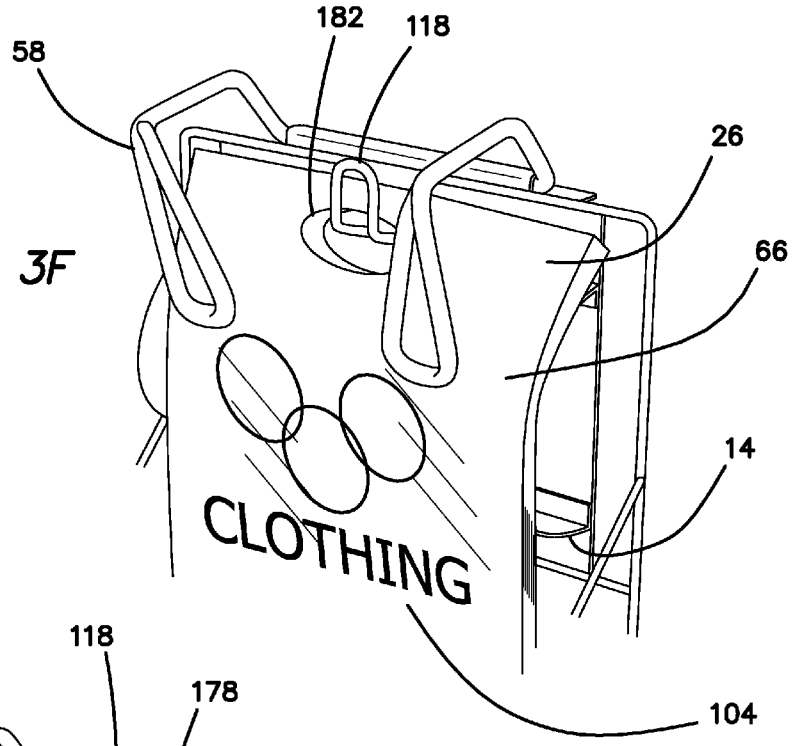
FIG. 3F is a partial perspective view of the FIG. 1 embodiment illustrating a dispenser loaded with oval handle bags.
Figure 4E:
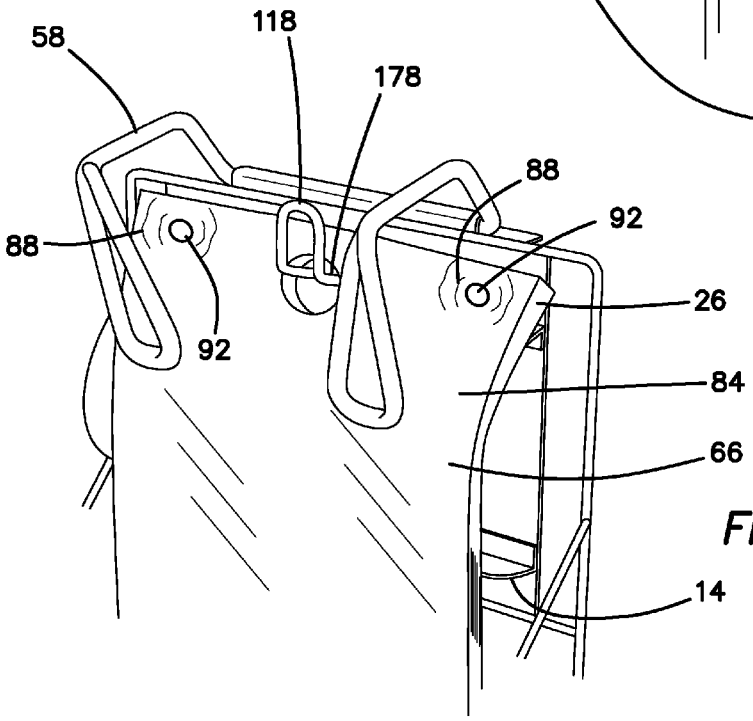
FIG. 4E is a partial perspective view of the FIG. 1 embodiment illustrating a dispenser loaded with round handle bags having a corona treatment and pressure adhesion means.
Figure 4F:
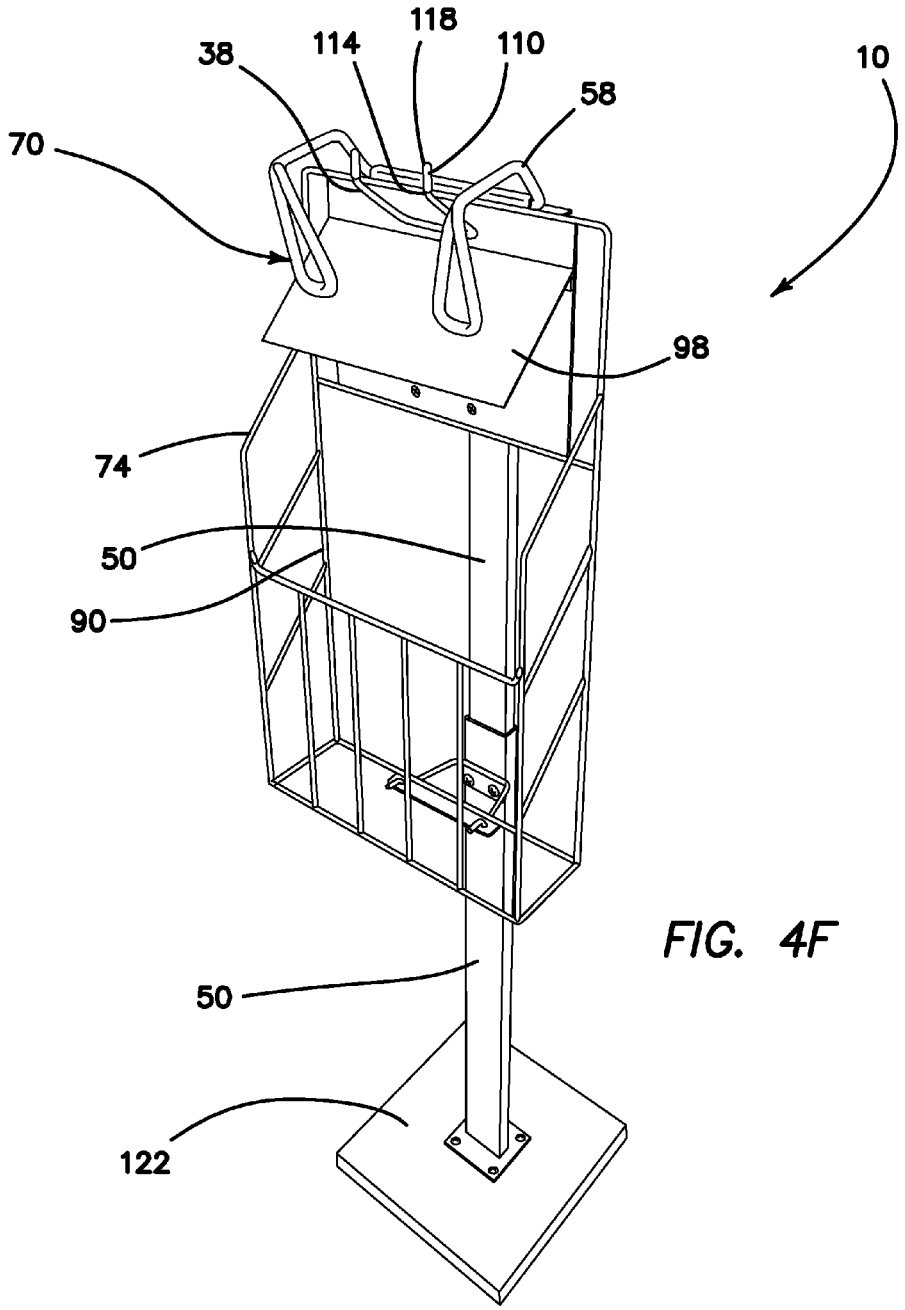
FIG. 4F is a partial perspective view of the FIG. 1 embodiment illustrating a dispenser with a canopy-style angled bag support platform.

(26) In another variant of the invention, as illustrated in FIG. 3E, the bag 80 further includes a top seam 24, a bottom seam 28, a U-shaped cut-out 32 commencing at the top seam 24, extending downwardly toward the bottom seam 28, proceeding across the bag 80 and rejoining the top seam 24, a central hanging aperture 36, the top seam 24 and bag material 108 adjacent the U-shaped cut-out 32 forming first 76 and second 78 bag handles, the bag handles 76, 78 have first 68 and second 72 hanging apertures located in an upper portion 112 of the handles 76,78.

(27) In still another variant, the bag 80 further includes at least one side gusset 48.

(28) In yet another variant, as illustrated in FIGS. 3D, 3F, 4D and 4E, the bag pack 26 further includes self-opening bags 84. The self-opening bags 84 employ technology selected form the group comprising: corona treatment 88, corona treatment with pressure 92, knife cutting 96, adhesives 100, hot staking (not shown), cold pinning (not shown), special material formulations (not shown) and adhering inks 104.

(29) In a further variant, the special material formulation includes 40-48 wt. % high density, high molecular weight polyethylene, 12-20 wt. % high density, medium molecular weight polyethylene, 20-30 wt. % linear low density polyethylene, 0-8 wt. % color concentrate.

(30) In still a further variant, the special material formulation further includes 0.5 wt. % slip and antiblock compound.

(31) In yet a further variant, the special material formulation further includes 1-3 wt. % calcium carbonate.

(32) In another variant of the invention, the special material formulation further includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(33) In still another variant, 10-15 wt. % of the linear low density polyethylene has a density ranging from 0.923-0.924 gm/cc.

(34) In yet another variant, 10-15 wt. % of the linear low density polyethylene has a melt index ranging from 0.25-0.30 gm/10 minutes.

(35) In a further variant, the high density, medium molecular weight polyethylene has a density ranging from 0.937-0.947 gm/cc.

(36) In still a further variant of the invention, the high density, medium molecular weight polyethylene has a melt index ranging from 0.10-0.30 gm/10 minutes.

Figure 1D:
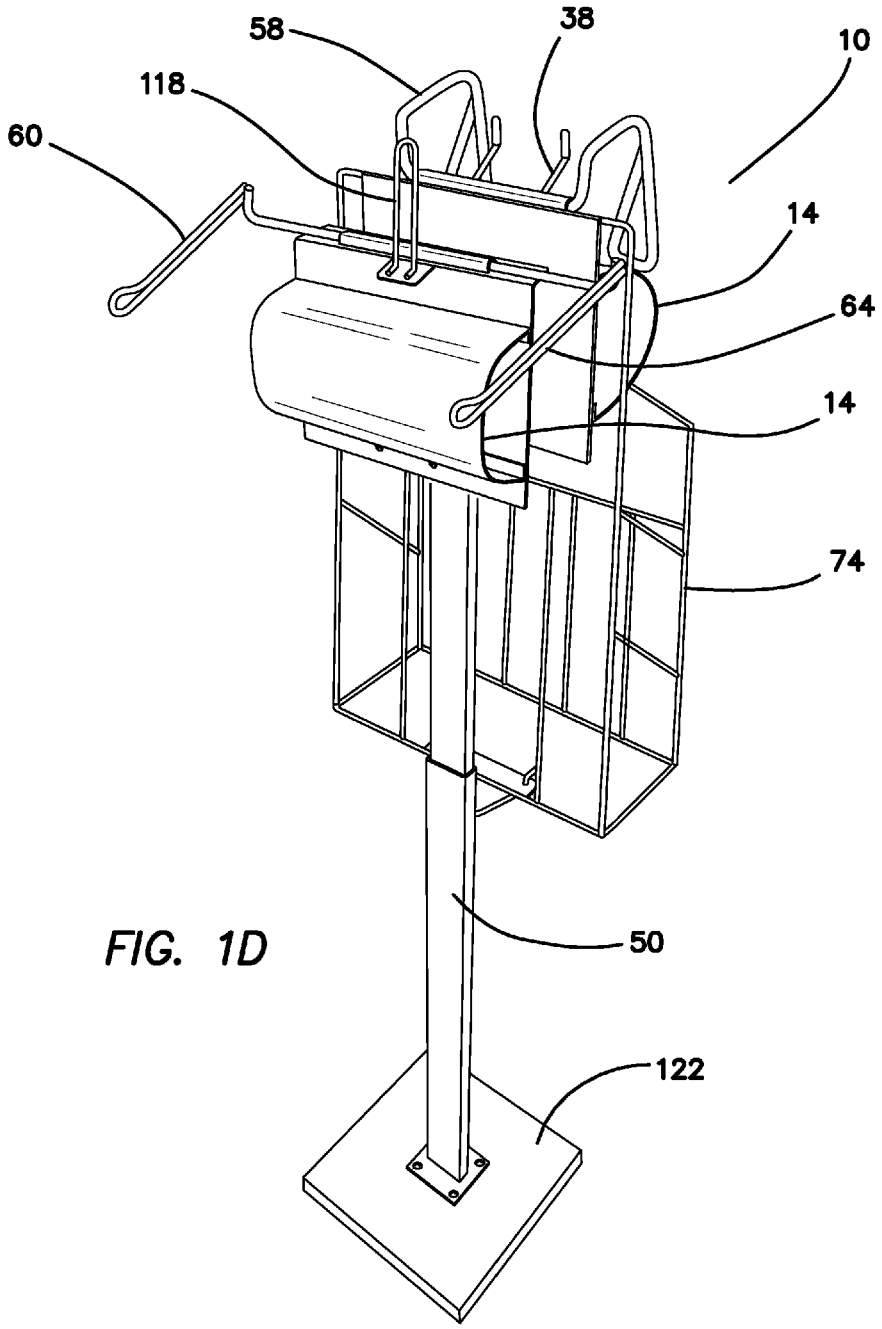
FIG. 1D is a perspective view of the FIG. 1 embodiment illustrating the positioning system supporting two bag support platforms, one adapted for use with T-shirt style bags.
Figure 1E:
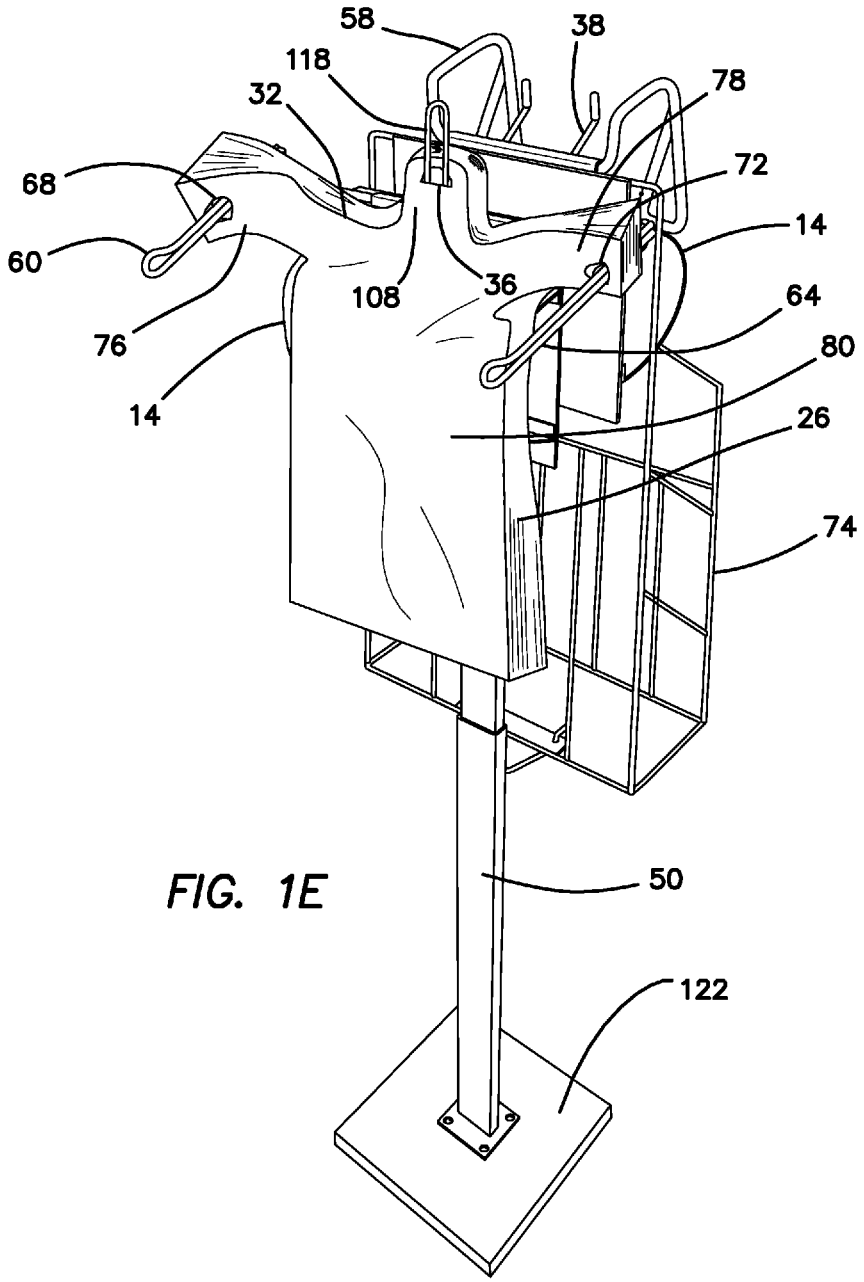
FIG. 1E is a perspective view of the FIG. 1 embodiment with a pack of T-shirt bags mounted on the dispenser.

(37) In yet a further variant, as illustrated in FIGS. 1D and 1E, a central mounting hook 118 and first 60 and second 64 horizontal control arms are provided. The mounting hook 118 and the control arms 60, 64 are attached either to or adjacent to one of the at least two of the bag support platforms 14. The mounting hook 118 and the first 60 and second 64 horizontal control arms are sized, shaped and located to align with hanging apertures 36, 68, 72 located in bag material 108 adjacent a U-shaped cut-out 32 and handles 76, 78 of a T-shirt style bag 80, respectively.

Figure 1F:
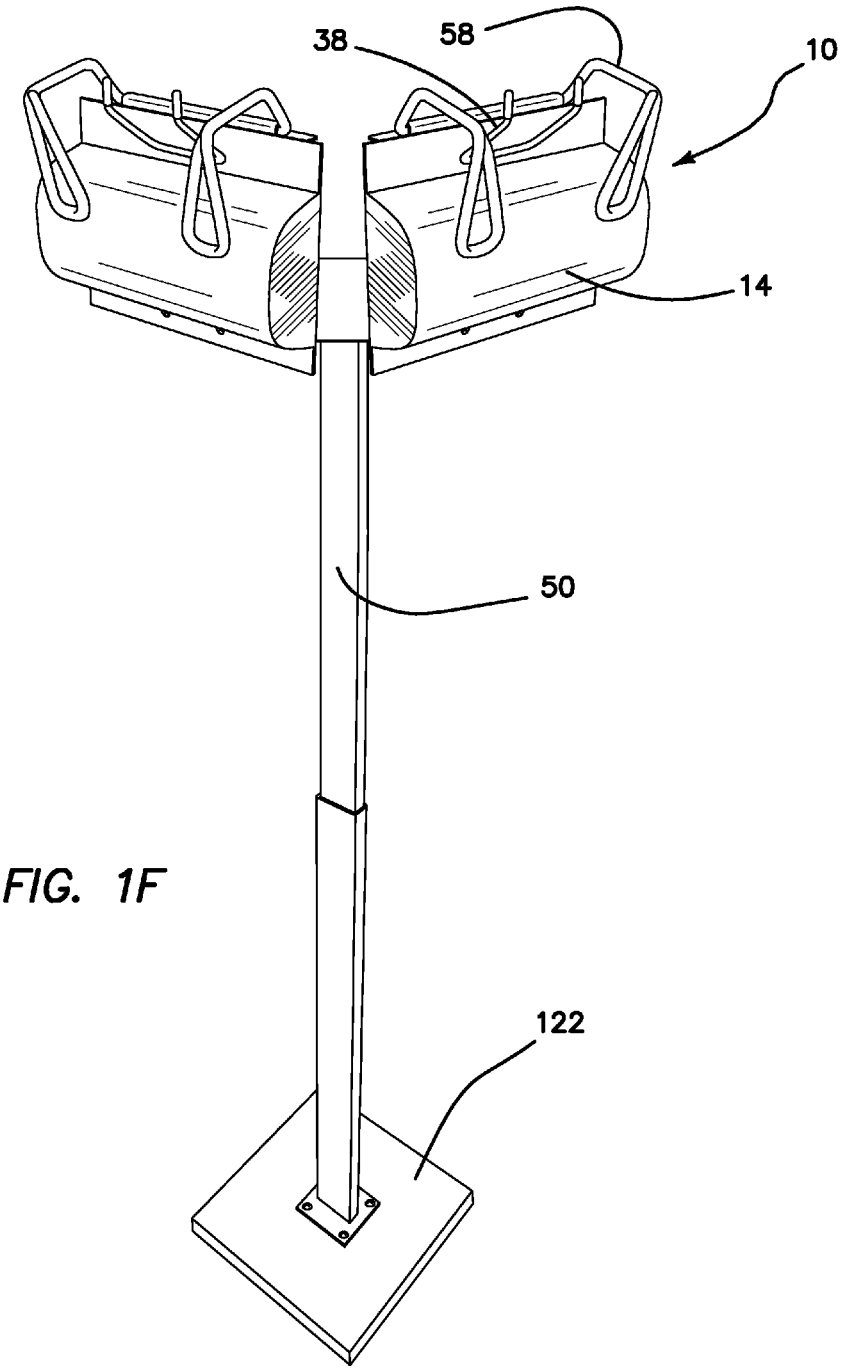
FIG. 1F is a perspective view of two of the FIG. 1 embodiment mounted at right angles to each other.
Figure 1G:
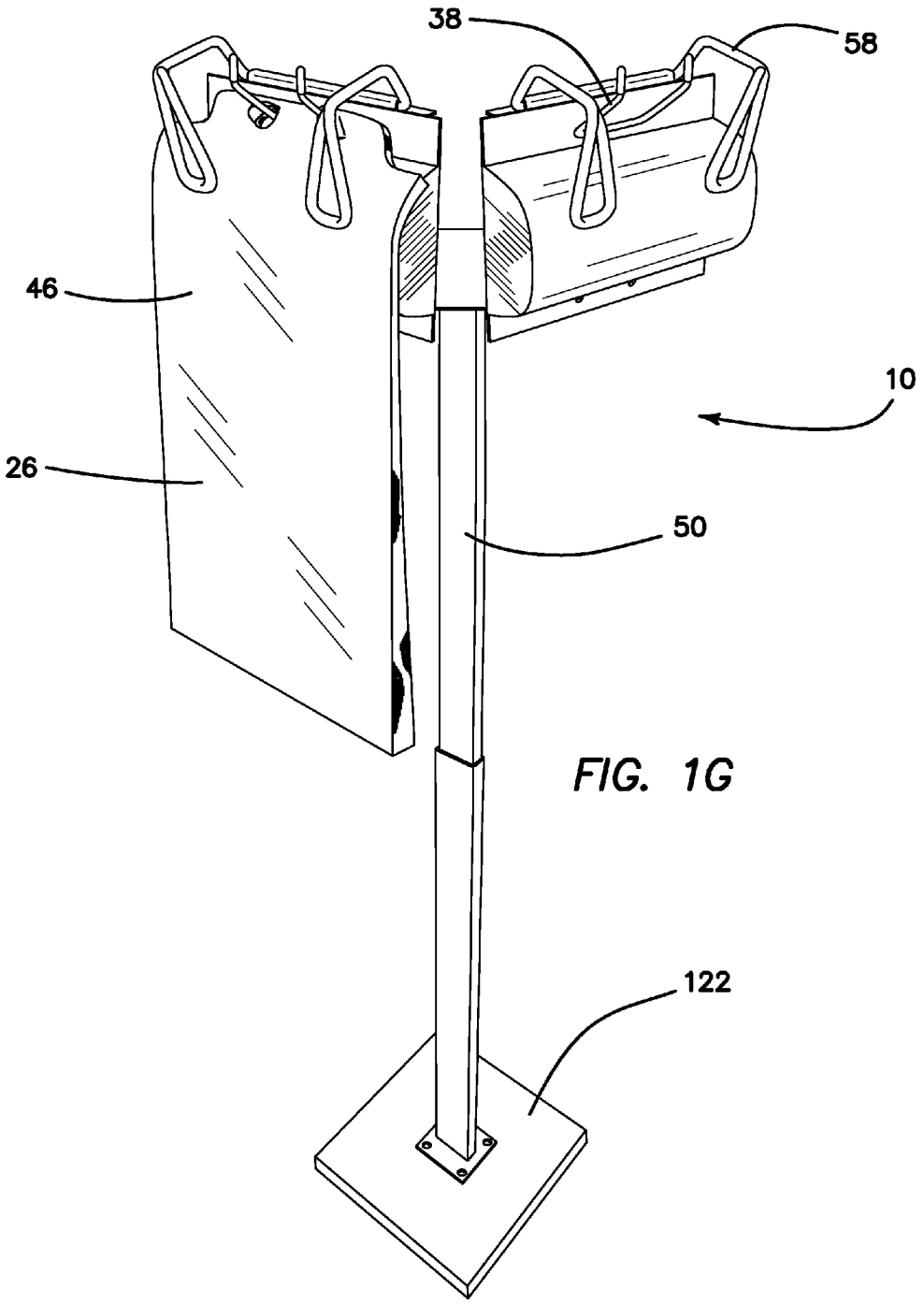
FIG. 1G is a perspective view of the FIG. 1F embodiment with a bag pack attached.
Figure 1H:
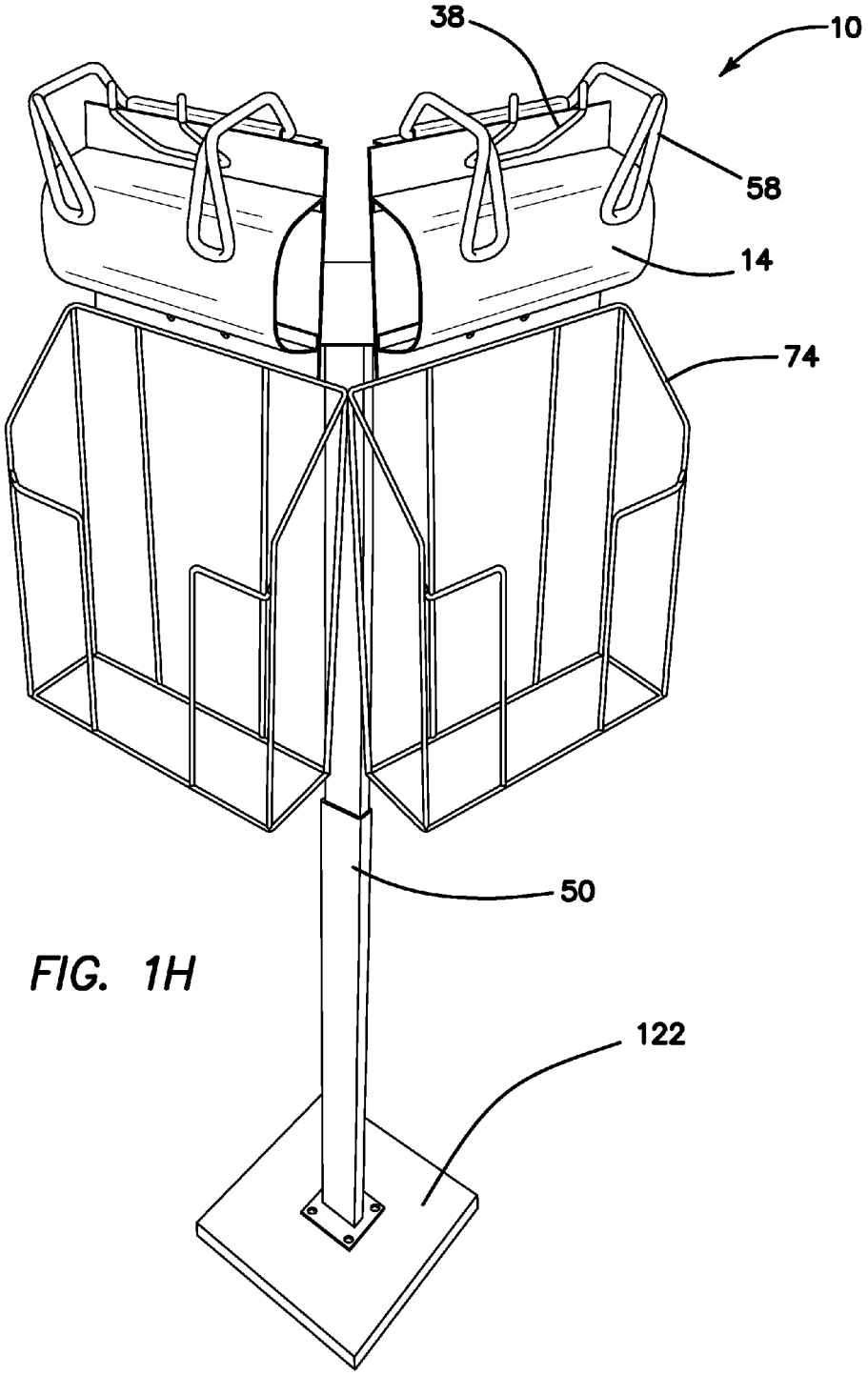
FIG. 1H is a perspective view of the FIG. 1F embodiment illustrating a removable surrounding control device.
Figure 2:
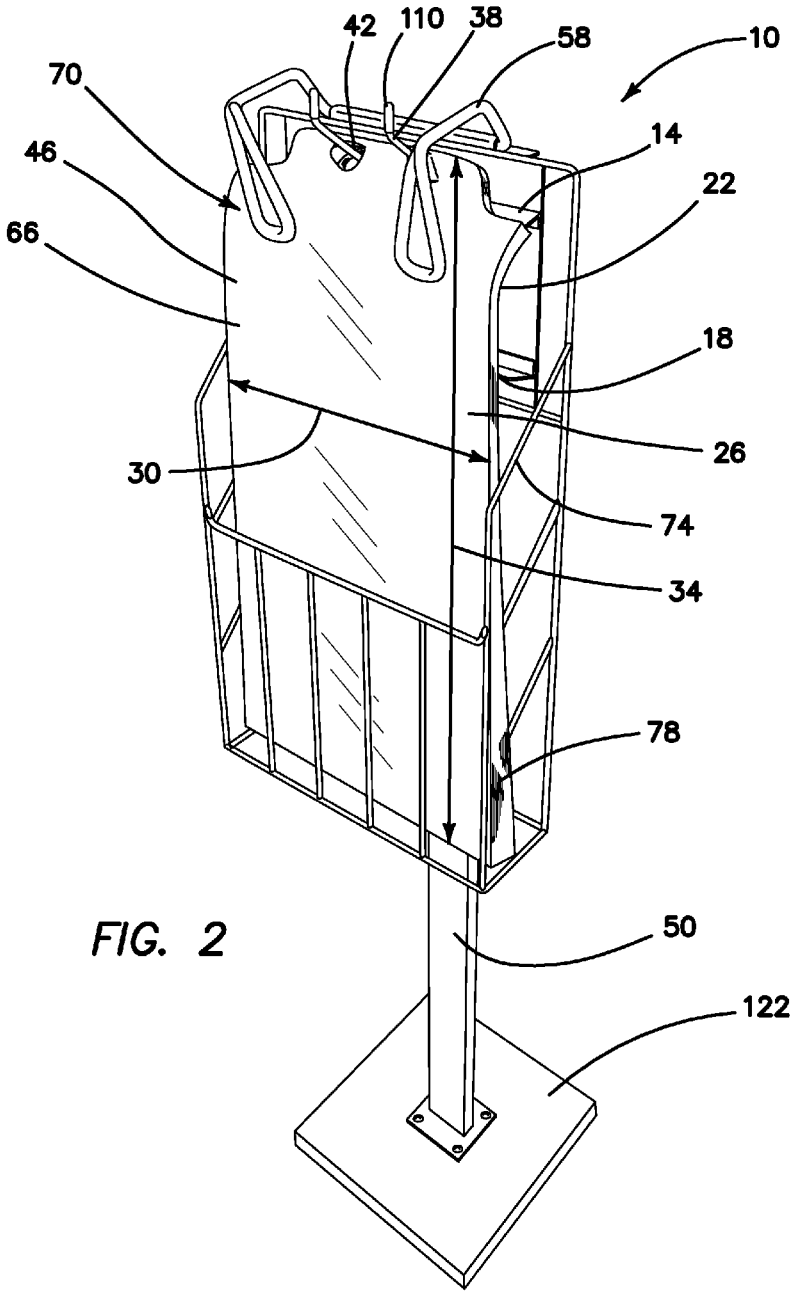
FIG. 2 is a perspective view of the FIG. 1 embodiment with a bag pack installed.

(38) In another variant of the invention, as illustrated in FIGS. 1F, 1G and 1H, the positioning system 50 supports two bag support platforms 14. The platforms 14 are located at right angles to each other.

(39) In a final variant of the invention, as illustrated in FIG. 1H, the dispenser 10 includes at least one removable surrounding control device 74. The device 74 is attached to either the bag support platform 14 or the positioning system 50. The device 74 is sized shaped and located to surround at least a lower portion 78 of the bag pack 26, thereby preventing a user 82 from pulling a bag 46 from a lower portion 86 of the bag 46.

The hanging bag dispenser 10 has been described with reference to particular embodiments. Other modifications and enhancements can be made without departing from the spirit and scope of the claims that follow.

The invention claimed is:

1. A hanging bag dispenser comprising:

a bag support platform, said platform providing a surface, said surface contacting a last bag in a vertically supported bag pack, said bag pack having a first predetermined width and a first predetermined length;

at least one mounting device, said device being attached to said bag support platform and being sized, shaped and disposed to engage a mounting aperture, said aperture penetrating each bag in said bag pack;

a positioning system, said system being attached to said bag support platform and maintaining said bag support platform at a height sufficient to allow said bag pack to extend downwardly for at least said first predetermined length;

said bag support platform being horizontally oriented and having either of a cylindrical and convex curved semicircular surface, said surface being attached to a plate, said plate being attached to said positioning system, said surface extending outwardly from said positioning system and being either of cylindrical and convex for its entire width where it contacts said vertically supported bag pack;

at least one pivotally mounted rigid bag control arm, said rigid bag control arm being mounted to said bag support platform and being sized shaped and disposed to permit installation of said bag pack on said at least one mounting device when pivoted to a loading position and disposed to constrain an outermost bag in said bag pack when pivoted to a control position; and said at least one pivotally mounted rigid bag control arm configured to contact said outermost bag in said vertically supported bag pack at only a surface adjacent to a distal end of said at least one pivotally mounted rigid bag control arm when said rigid bag control arm is pivoted to said control position.

2. The hanging bag dispenser, as described in claim 1, wherein said at least one mounting device is upwardly angled.

3. The hanging bag dispenser, as described in claim 1, wherein said at least one mounting device comprises a bendable tab.

4. The hanging bag dispenser, as described in claim 1, wherein said at least one mounting device comprises an angled hook.

5. The hanging bag dispenser, as described in claim 1, wherein said positioning system is selected from the group comprising:

floor stands, wall mounts, surface mounts, counter mounts, glue, screws, nails and looping and hooking fasteners (Velcro®).

6. The hanging bag dispenser, as described in claim 1, further comprising first and second horizontal control arms, said control arms being attached either of to and adjacent to said bag support platform and being sized, shaped and disposed to align with hanging apertures disposed in handles of a T-shirt style bag.

7. The hanging bag dispenser, as described in claim 1, further comprising a surrounding control device, said device being attached to either of said bag support platform and said positioning system, and being sized shaped and disposed to surround at least a lower portion of said bag pack, thereby preventing a user from pulling a bag from a lower portion of said bag.

8. The hanging bag dispenser, as described in claim 7 wherein said control device is of wire form construction.

9. The hanging bag dispenser, as described in claim 7 wherein said control device is formed of wood, plastic or metal.

10. The hanging bag dispenser, as described in claim 1, wherein said at least one mounting device is a mounting spike.

11. The hanging bag dispenser, as described in claim 10, wherein said mounting spike has an angled portion adjacent a distal end of said spike.

12. The hanging bag dispenser, as described in claim 1, wherein said at least one mounting device is slidably mounted to said bag support platform and adapted to accommodate bags having a variety of differently located mounting apertures.

13. The hanging bag dispenser, as described in claim 1, wherein said at least one mounting device is a mounting hook.

14. The hanging bag dispenser, as described in claim 13, wherein said mounting hook is slidably mounted to said bag support platform and adapted to accommodate bags having a variety of differently located mounting apertures.

15. The hanging bag dispenser, as described in claim 1, wherein said positioning system further comprises any of a floor stand, a counter mount, and a surface mount, said positioning system adapted to support at least two of said bag support platform.

16. The hanging bag dispenser, as described in claim 1, wherein said positioning system is a wall mount, said wall mount being disposed adjacent a lower portion of said bag support platform and supporting said bag support platform.

17. The hanging bag dispenser, as described in claim 1, wherein said positioning system is a counter mount, said counter mount being disposed adjacent a lower portion of said bag support platform and supporting said bag support platform.

18. The hanging bag dispenser, as described in claim 1, wherein said at least one pivotally mounted rigid bag control arm comprises at least one weight, said weight providing increased friction between said control arm and said outermost bag.

19. The hanging bag dispenser, as described in claim 1, wherein said at least one pivotally mounted bag control arm comprises first and second bag control elements; said first and second elements being attached to a pivot rod, said pivot rod being slidably disposed within a bearing structure, said bearing structure being attached to said bag support platform.

20. The hanging bag dispenser, as described in claim 1, wherein said bag further comprises a central handle, said central handle selected from the group comprising: round, oval, kidney-shaped and racetrack (elongated round).

21. The hanging bag dispenser, as described in claim 6, wherein said bag further comprises a top seam, a bottom seam, a U-shaped cut-out commencing at said top seam, extending downwardly toward said bottom seam, proceeding across said bag and rejoining said top seam, a central hanging aperture, said top seam and bag material adjacent said U-shaped cut-out forming first and second bag handles, said bag handles having first and second hanging apertures disposed in an upper portion of said handles.

22. The hanging bag dispenser, as described in claim 21, wherein said bag further comprises at least one side gusset.

23. The hanging bag dispenser, as described in claim 1, wherein said bag pack further comprises self-opening bags, said self-opening bags employing technology selected form the group comprising: corona treatment, corona treatment with pressure, knife cutting, adhesives, hot staking, cold pinning, special material formulations and adhering inks.

24. The hanging bag dispenser, as described in claim 23, wherein the special material formulation comprises 40-48 wt. % high density, high molecular weight polyethylene, 12-20 wt. % high density, medium molecular weight polyethylene, 20-30 wt. % linear low density polyethylene, 0-8 wt. % color concentrate.

25. The hanging bag dispenser, as described in claim 24, wherein the special material formulation further comprises 0.5 wt. % slip and antiblock compound.

26. The hanging bag dispenser, as described in claim 23, wherein the special material formulation further comprises 1-3 wt. % calcium carbonate.

27. The hanging bag dispenser, as described in claim 23, wherein the special material formulation further comprises 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

28. The hanging bag dispenser, as described in claim 23, wherein 10-15 wt. % of said linear low density polyethylene has a density ranging from 0.923-0.924 gm/cc.

29. The hanging bag dispenser, as described in claim 23, wherein 10-15 wt. % of said linear low density polyethylene has a melt index ranging from 0.25-0.30 gm/10 minutes.

30. The hanging bag dispenser, as described in claim 23, wherein said high density, medium molecular weight polyethylene has a density ranging from 0.937-0.947 gm/cc.

31. The hanging bag dispenser, as described in claim 23, wherein said high density, medium molecular weight polyethylene has a melt index ranging from 0.10-0.30 gm/10 minutes.

32. The hanging bag dispenser, as described in claim 15, further comprising a central mounting hook and first and second horizontal control arms, said mounting hook and said control arms being attached either of to and adjacent to one of said at least two of said bag support platform and being sized, shaped and disposed to align with hanging apertures disposed in bag material adjacent a U-shaped cut-out and handles of a T-shirt style bag, respectively.

33. The hanging bag dispenser, as described in claim 15, wherein said positioning system supports two bag support platforms, said platforms being disposed at right angles to each other.

34. The hanging bag dispenser, as described in claim 33, further comprising at least one removable surrounding control device, said device being attached to either of said bag support platform and said positioning system, and being sized shaped and disposed to surround at least a lower portion of said bag pack, thereby preventing a user from pulling a bag from a lower portion of said bag.

* * * * *